US010996636B2

(12) United States Patent
Morohoshi

(10) Patent No.: US 10,996,636 B2
(45) Date of Patent: May 4, 2021

(54) COMMUNICATION DEVICE, ELECTRONIC TIMEPIECE, COMMUNICATION METHOD, AND RECORDING MEDIUM

(71) Applicant: CASIO COMPUTER CO., LTD., Tokyo (JP)

(72) Inventor: Hiroshi Morohoshi, Tokorozawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 434 days.

(21) Appl. No.: 15/900,445

(22) Filed: Feb. 20, 2018

(65) Prior Publication Data

US 2018/0267484 A1 Sep. 20, 2018

(30) Foreign Application Priority Data

Mar. 16, 2017 (JP) ..... JP2017-051447

(51) Int. Cl.
*G04R 20/26* (2013.01)

(52) U.S. Cl.
CPC ..... *G04R 20/26* (2013.01)

(58) Field of Classification Search
CPC ..... G04R 20/02; G04R 20/08; G04R 20/14; G04R 20/20; G04R 20/26
See application file for complete search history.

(56) References Cited

U.S. PATENT DOCUMENTS 4,234,958 A * 11/1980 Pipes ..... G04R 40/00 368/47
5,528,560 A * 6/1996 Ogiyama ..... G04G 3/022 368/47
2003/0198140 A1 10/2003 Shimizu et al.
2004/0047244 A1* 3/2004 Iino ..... G04R 20/08 368/276
2004/0190379 A1* 9/2004 Akiba ..... G04R 20/26 368/47
2007/0230285 A1* 10/2007 Nakagawa ..... G04R 20/02 368/47

(Continued)

FOREIGN PATENT DOCUMENTS

JP 2002139586 A 5/2002
JP 2004003929 A 1/2004

(Continued)

*Primary Examiner* — Daniel P Wicklund
(74) *Attorney, Agent, or Firm* — Holtz, Holtz & Volek PC

(57) ABSTRACT

The communication device includes a receiver, a counter, an operation member and a processor. The receiver receives an external time from an external device. The counter clocks time. The operation member receives a time correction operation to correct the time clocked by the counter. The processor corrects the time clocked by the counter to the received external time. The processor sets a frequency at which the time correction process is performed after the operation member receives the time correction operation, higher than a frequency at which the time correction process is performed before the operation member receives the time correction operation, until a predetermined time elapses. In the time correction process, when the difference between the time clocked by the counter and the external time received by the receiver is within a predetermined range, the processor corrects the time clocked by the counter to the external time.

9 Claims, 21 Drawing Sheets

(56) References Cited

U.S. PATENT DOCUMENTS

| | | | | |
|---|---|---|---|---|
| 2009/0135677 | A1* | 5/2009 | Veillette | G04R 40/06<br>368/47 |
| 2014/0241133 | A1* | 8/2014 | Baba | G04R 20/04<br>368/47 |
| 2017/0277140 | A1* | 9/2017 | Akiyama | G04R 20/02 |
| 2018/0372880 | A1* | 12/2018 | Matsue | H03K 3/0307 |

FOREIGN PATENT DOCUMENTS

| | | | |
|---|---|---|---|
| JP | 2005351674 | A | 12/2005 |
| JP | 2006322812 | A | 11/2006 |
| JP | 2009118403 | A | 5/2009 |
| JP | 2011174870 | A | 9/2011 |
| JP | 2017026576 | A | 2/2017 |

* cited by examiner (CONT.)

(FIG. 7 CONTINUED)
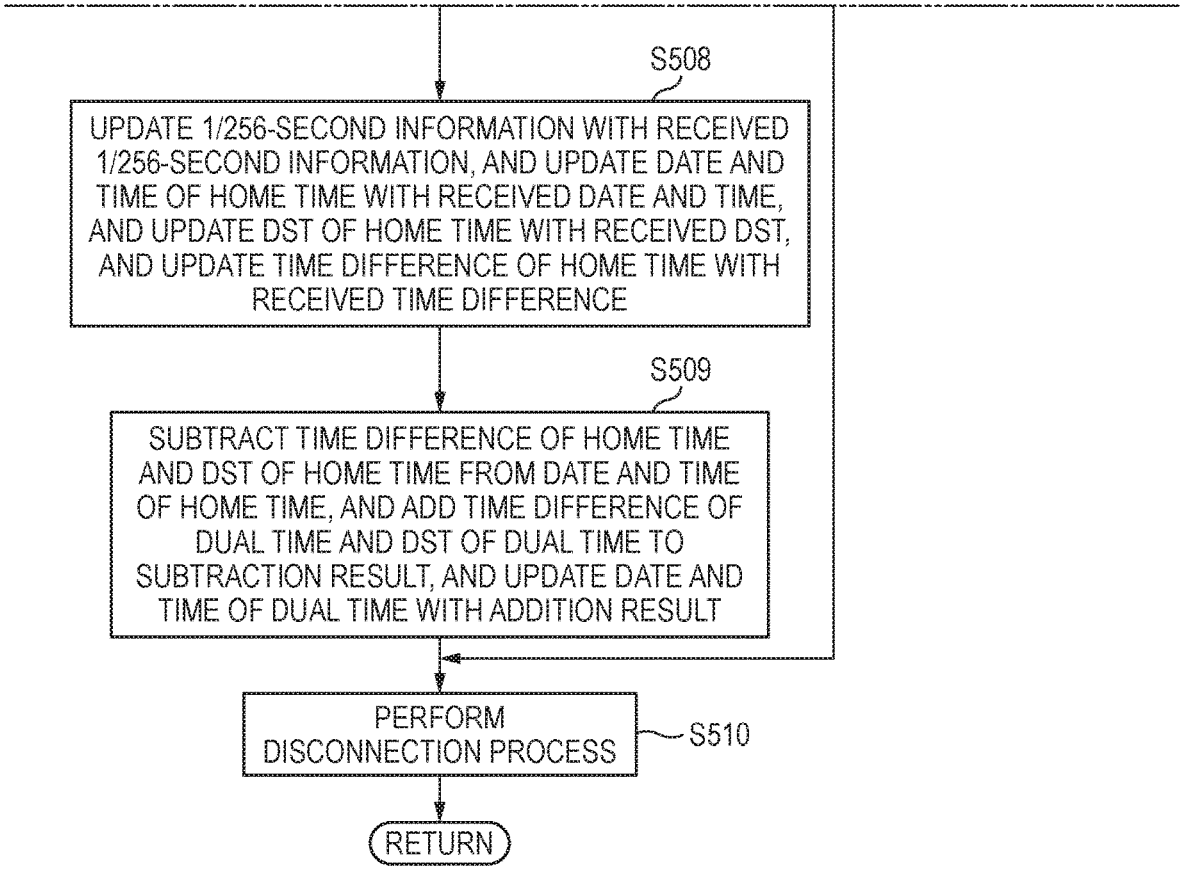

FIG. 9

231

| CITY CODE | TIME DIFFERENCE |
|---|---|
| UTC | 0 |
| LONDON (LON) | 0 |
| PARIS (PAR) | +1 |
| ATHENS (ATH) | +2 |
| TOKYO (TYO) | +9 |
| ⋮ | ⋮ |

(CONT.)

(FIG. 10 CONTINUED)
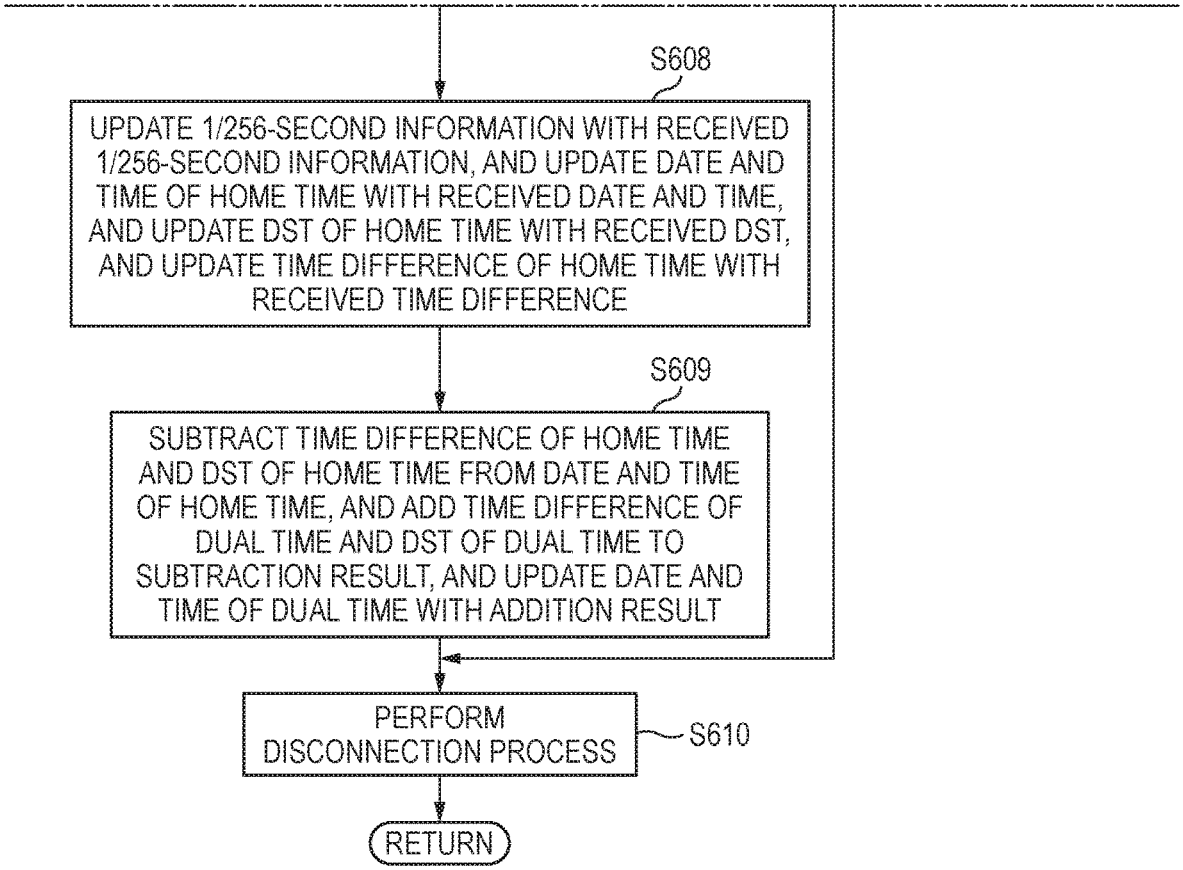

COMMUNICATION DEVICE, ELECTRONIC TIMEPIECE, COMMUNICATION METHOD, AND RECORDING MEDIUM

CROSS-REFERENCE TO RELATED APPLICATION

This application is based upon and claims the benefit of priority under 35 USC 119 of Japanese Patent Application No. 2017-051447 filed on Mar. 16, 2017, the entire disclosure of which, including the description, claims, drawings, and abstract, is incorporated herein by reference in its entirety.

BACKGROUND

1. Field of the Invention

The present invention relates to a communication device, an electronic timepiece, a communication method, and a recording medium.

2. Description of the Related Art

Electronic timepieces having a function of accessing a mobile phone such as a smart phone or a feature phone by near field communication and automatically correcting the time are known. For example, JP-A-2009-118403 discloses a time correction system, a portable phone set, and a wristwatch type portable phone terminal for connecting a portable phone and the wristwatch type terminal is connected by Bluetooth (registered as a trade mark) and adjusting the clock of the wristwatch type with reference to the clock of the portable phone. Also, recently, electronic timepieces configured to automatically perform time correction using Bluetooth (registered as a trade mark) Low Energy (BLE) instead of Bluetooth (registered as a trade mark) have begun to appear. Such an electronic timepiece tends to increase the frequency of automatic time correction in order to display the local time in a foreign destination as soon as a user arrives at the destination by plane.

A wristwatch type terminal as disclosed in the above-mentioned Patent Document automatically accesses a portable phone several times a day such that if a user moves to another time zone, the time can be quickly changed. Meanwhile, since the time is accurate within about 15 seconds per month, for a user who do not frequently move from a time zone to another time zone, it is unnecessary to perform automatic time correction several times a day, and due to unnecessary automatic time correction, a lot of power is wasted.

SUMMARY

A communication device, an electronic timepiece, a communication method, and a recording medium are disclosed.

According to one aspect of this disclosure, a communication device includes a receiver, a counter, an operation member and a processor. The receiver receives an external time from an external device. The counter clocks time. The operation member receives a time correction operation from a user to correct the time clocked by the counter. The processor controls the receiver to receive the external time, and to correct the time clocked by the counter to the received external time. The processor sets a frequency at which the time correction process is performed after the operation member receives the time correction operation, higher than a frequency at which the time correction process is performed before the operation member receives the time correction operation, until a predetermined time elapses. In the time correction process, when the difference between the time clocked by the counter and the external time received by the receiver is within a predetermined range, the processor corrects the time clocked by the counter to the external time.

BRIEF DESCRIPTION OF THE DRAWINGS

FIG. 9 is a view illustrating examples of data items which are stored in a city/time-difference memory according to the second embodiment.

DETAILED DESCRIPTION

Hereinafter, embodiments will be described with reference to the accompanying drawings.

First Embodiment

Figure 1:
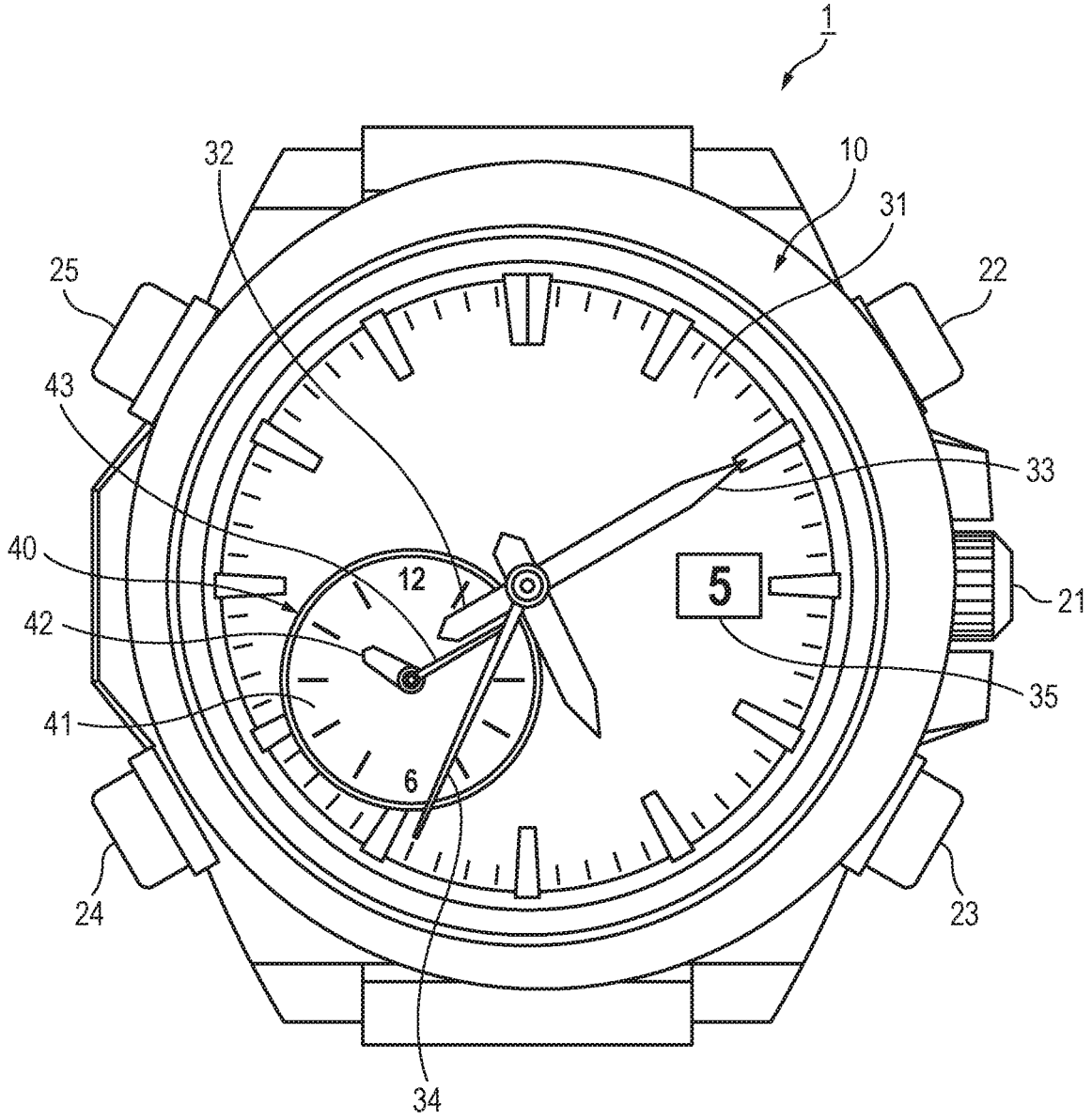
FIG. 1 is a view illustrating an example of the configuration of an electronic timepiece according to a first embodiment.

FIG. 1 is a view illustrating the external appearance of an electronic timepiece 1 (a communication device) according to a first embodiment of the present invention. The electronic timepiece 1 includes a case 10 having a top configured with a windshield, and a crown 21 and push button switches 22 to 25 disposed on the side surface of the case 10. Also, inside the case 10, a dial plate 31, various hands (an hour hand 32, a minute hand 33, and a second hand 34), and a date wheel 35 are provided so as to be visible through the windshield. The dial plate 31 has markings and gradations to indicate time. The individual hands (the hour hand 32, the minute hand 33, and the second hand 34) rotate on the dial plate 31 to indicate the current time in a first region, i.e. the current time (local time) in the first region. The date wheel 35 displays the current date. In the following description, the time which is indicated by the hands (the hour hand 32, the minute hand 33, and the second hand 34) will also be referred to as the home time.

Further, a small timepiece 40 is provided in the direction of 9 o'clock on the dial plate 31. The small timepiece 40 includes a dial plate 41 and various hands (an hour hand 42 and a minute hand 43). The individual hands (the hour hand 42 and the minute hand 43) can rotate on the dial plate 41 to indicate a time (for example, a local time in a second region) different from the home time. In the following description, the time which is indicated by the hands (the hour hand 42 and the minute hand 43) of the small timepiece 40 will also be referred to as the dual time.

The crown 21 and the push button switches 22 to 25 each receive input operations from a user. The crown 21 can be pulled out in two stages from the case 10, and by pulling out the crown to a position corresponding to the second stage and rotating the crown, the user can manually correct the time difference between the time of the home time and Coordinated Universal Time (UTC). The push button switches 22 to 25 can be operated to change a correction mode, switch to or from daylight saving time, interchange the home time and the dual time, access an external device, and perform other operations.

Figure 2:
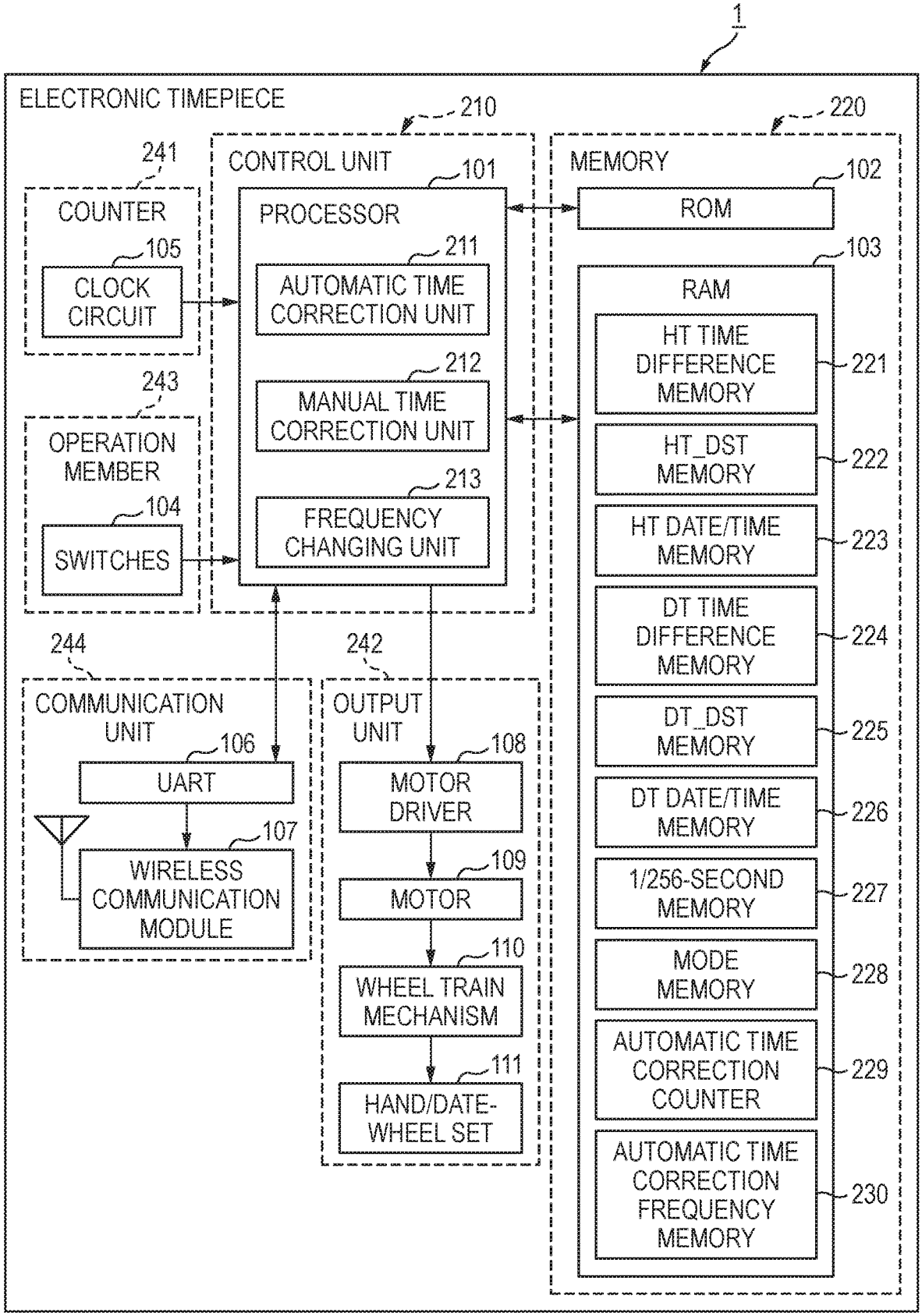
FIG. 2 is a block diagram illustrating the configuration of the electronic timepiece according to the first embodiment.

Now, the hardware configuration of the electronic timepiece 1 will be described. As shown in FIG. 2, the electronic timepiece 1 includes a processor 101, a read only memory (ROM) 102, a random access memory (RAM) 103, switches 104, a clock circuit 105, a universal asynchronous receiver transmitter (UART) 106, a wireless communication module 107, a motor driver 108, a motor 109, a wheel train mechanism 110, and a hand/date-wheel set 111.

The processor 101 generally controls the whole of the electronic timepiece 1 by executing various control programs. In the ROM 102, the control programs to be executed by the processor 101, and a variety of data necessary to execute the control programs are stored in advance. The RAM 103 is configured to store a variety of data generated or changed during execution of the control programs, and functions a work space which the processor 101 can use to work.

The switches 104 receive input operations from the user, and output electric signals according to the input operations. The switches 104 include the crown 21 and the push button switches 22 to 25 described above.

The clock circuit 105 includes a crystal oscillator, a frequency divider circuit, and the like, and clocks the current date and time by counting the number of signals acquired from the frequency divider circuit, and outputs the clocked result to the processor 101.

The UART 106 performs conversion between parallel signals which the processor 101 handles and serial signals which the wireless communication module 107 handles. The wireless communication module 107 includes an antenna, one of a pair of a transmitter and a receiver, a transceiver, and a communication circuit for radio frequency (RF), a baseband (BB) circuit, a memory circuit, and other circuits, and performs data communication with an external communication device such as a smart phone. An automatic time correction process to be described below is performed via the wireless communication module 107.

The motor driver 108 outputs drive pulse signals to the motor 109 on the basis of instructions from the processor 101. The motor 109 is a stepping motor, and drives the wheel train mechanism 110 according to drive pulses input from the motor driver 108. However, the motor 109 may be configured with a motor other than stepping motors.

The wheel train mechanism 110 is configured with a combination of a plurality of gears. According to rotation of the motor 109, the wheel train mechanism 110 rotates the hands and the date wheel included in the hand/date-wheel set 111 by predetermined angles, respectively. In general, a plurality of motors 109, a plurality of wheel train mechanisms 110, and a plurality of hand/date-wheel sets 111 are provided for various types of hands and date wheels, respectively.

For example, whenever the processor 101 rotates a motor 109 for the hour hand once by two minutes, the hour hand of the hand/date-wheel set 111 is rotated 1 degree by the wheel train mechanism 110 for the hour hand. Also, whenever the processor 101 rotates a motor 109 for the minute hand once by one second, the second hand of the hand/date-wheel set 111 is rotated 0.1 degrees by the wheel train mechanism 110 for the minute hand. Further, whenever the processor 101 rotates a motor 109 for the dual time for 60 seconds, by the wheel train mechanism 110 for the dual time, the minute hand of the hand/date-wheel set 111 of the small timepiece 40 is rotated 6 degrees and the minute hand of the hand/date-wheel set 111 is rotated 0.5 degrees.

Although the case where the electronic timepiece 1 is an analog timepiece configured such that hands and a date wheel move mechanically has been described above, the electronic timepiece 1 may be a digital timepiece configured to display date and time on a display screen configured with a display device such as a liquid crystal display, an organic electro-luminescence (EL) display, or the like. For example, in the case where the electronic timepiece 1 is a digital timepiece having a liquid crystal screen, the electronic timepiece includes a liquid crystal driver and a liquid crystal display, in place of the motor driver 108, the motor 109, the wheel train mechanism 110, and the hand/date-wheel set 111, and the processor 101 controls the liquid crystal display via the liquid crystal driver such that the liquid crystal display displays the current time.

Now, the functional configuration of the electronic timepiece 1 will be described. As shown in FIG. 2, the electronic timepiece 1 includes a control unit 210, a memory 220, a counter 241, an output unit 242, an operation member 243, and a communication unit 244.

The control unit 210 includes the processor 101 such as a central processing unit (CPU), and implements the functions of individual units of the electronic timepiece 1 (an automatic time correction unit 211, a manual time correction unit 212, and a frequency changing unit 213) by executing programs stored in the memory 220. The functions of the automatic time correction unit 211, the manual time correction unit 212, and the frequency changing unit 213 may be implemented by a single processor or the control unit 210, or processors or control units 210 may be provided for the corresponding units, respectively, and implement the functions of the corresponding units, respectively.

The control unit 210 which functions as the automatic time correction unit 211 performs a time correction process of correcting the time clocked by the counter 241. In the present embodiment, the control unit 210 receives the time of an external device such as a smart phone by performing communication with the external device via the communication unit 244, at a frequency stored in an automatic time correction frequency memory 230 to be described below. If the difference between the time of the home time stored in the memory 220 and the external time received by the communication unit 244 is within a predetermined range (for example, between −7.5 minutes and 7.5 minutes), the control unit 210 corrects the time of the home time stored in the memory 220, to the external time.

In the case where the control unit 210 functions as the manual time correction unit 212, if a user's time correction operation is received by the operation member 243, the control unit corrects the time clocked by the counter 241, on the basis of the received time correction operation. In the present embodiment, the operation member 243 receives an operation for correcting the time clocked by the counter 241 to a time designated by the user, as a time correction operation. Then, the control unit 210 corrects the time of the home time stored in the memory 220 to the time designated by the user.

In the case where the control unit 210 functions as the frequency changing unit 213, if the operation member 243 receives a time correction operation, the control unit sets a frequency at which the time correction process should be performed, higher than that before the reception of the time correction operation, until a predetermined time (for example, 24 hours) elapses. In the present embodiment, if the operation member 243 receives a time correction operation, the control unit 210 sets 24 in an automatic time correction counter 229 (to be described below), and counts 24 hours as the predetermined time by subtracting 1 from the value of the automatic time correction counter 229 whenever one hour elapses. Also, if the operation member 243 receives the time correction operation, the control unit 210 updates the number of times of automatic time correction per day stored in the automatic time correction frequency memory 230 (to be described below) with 24, thereby changing the frequency at which the time correction process should be performed such that time correction is performed 24 times a day, in other words, at intervals of one hour. Further, if the value of the automatic time correction counter 229 becomes 0, the control unit 210 updates the number of times of automatic time correction stored in the automatic time correction frequency memory 230 with 4, thereby changing the frequency at which the time correction process should be performed such that time correction is performed 4 times a day, in other words, at intervals of six hours.

The memory 220 includes the ROM 102, the RAM 103, and the like. The RAM 103 includes: a home time (HT) time difference memory 221 for storing the time difference of the home time (the time difference between the home time and Coordinated Universal Time (UTC)); an HT_DST (daylight saving time) memory 222 for storing the daylight saving time information of the home time; an HT date/time memory 223 for storing the date (year, month, and day) and the time (hours, minutes, and seconds) of the home time; a dual time (DT) time difference memory 224 for storing the time difference of the dual time (the time difference between the dual time and Coordinated Universal Time (UTC)); a DT_DST memory 225 for storing the daylight saving time of the dual time; a DT date/time memory 226 for storing the date (year, month, and day) and the time (hours, minutes, and seconds) of the dual time; a 1/256-second memory 227 for storing 1/256-second information (in units of 1/256 seconds) less than one second and usable in common by the home time and the dual time; a mode memory 228 for storing the current mode of the electronic timepiece 1 (such as a normal mode, a time correction mode, or the like); the automatic time correction counter 229 for counting the predetermined time if the operation member 243 receives a time correction operation; and the automatic time correction frequency memory 230 for storing the number of times of automatic time correction per day the time correction process should be performed.

The time differences which are stored in the HT time difference memory 221 and the DT time difference memory 224 can have values in a range between −12 hours and +14 hours. The daylight saving time information items which are stored in the HT_DST memory 222 and the DT_DST memory 225 can have 0 (standard time) or +1 hour (daylight saving time). The values which are stored in the HT date/time memory 223 and the DT date/time memory 226 are years, months, days, hours, minutes, and seconds. The value stored in the 1/256-second memory 227 is increased by 1 at intervals of 1/256 seconds by a clocking process of the counter 241 and the control unit 210 to be described below. Further, after the value stored in the 1/256-second memory 227 becomes 255, when 1/256 seconds elapses, the value stored in the 1/256-second memory 227 is updated with 0, and the second information item of the home time stored in the HT date/time memory 223 and the second information item of the dual time stored in the DT date/time memory 226 each are increased by 1. In addition, after the second information items of the home time and the dual time become 59 seconds, when 1 second elapses, the individual second information items are updated with 0, and the minute information items are increased by 1. The same is true for minute information and hour information.

The counter 241 includes the clock circuit 105, and clocks the current time, and outputs the clocked result to the control unit 210. On the basis of the clocked result input from the counter 241, the control unit 210 performs a clocking process of updating information stored in the HT date/time memory 223, the DT date/time memory 226, and 1/256-second memory 227 of the memory 220. However, the function of the counter 241 may be implemented by the control unit 210.

The output unit 242 includes a time display unit. The time display unit includes the motor driver 108, the motor 109, the wheel train mechanism 110, and the hand/date-wheel set 111, and indicates the current time. In the case where the electronic timepiece 1 is a digital timepiece having a liquid crystal display unit, the time display unit includes a liquid crystal driver and a liquid crystal display device.

The operation member 243 has the switches 104 including the crown 21 and the push button switches 22 to 25. In the present embodiment, the operation member 243 receives a time correction operation of the user for correcting the time clocked by the counter 241. For example, a time correction operation is an operation for correcting the time of the home time to a time designated by the user, such as an operation for interchanging the home time and the dual time, an operation for switching to or from daylight saving time, an operation for correcting the time difference of the home time, and an operation for correcting the date and time of the home time.

The communication unit 244 includes the wireless communication module 107, and performs data communication with an external device such as a smart phone. The contents of data communication include requesting to transmit time difference information and daylight saving time information for time correction, receiving information on time difference information and daylight saving time information for time correction, requesting to transmit date-and-time information and 1/256-second information, receiving date-and-time information and 1/256-second information, receiving a command for a remote operation, and so on.

Figure 3:
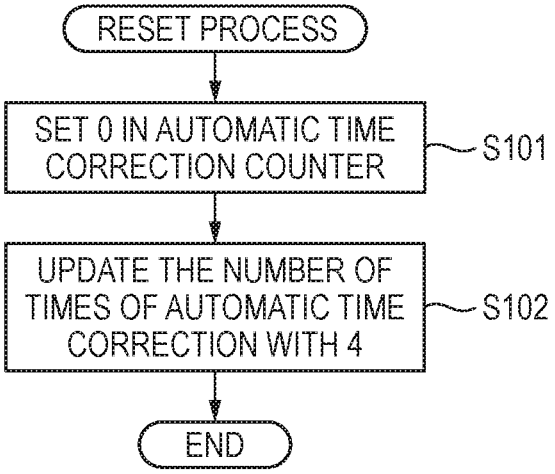
FIG. 3 is a flow chart illustrating the control procedure of a reset process which is performed by a control unit of the electronic timepiece according to the first embodiment.

Now, a reset process of the electronic timepiece 1 according to the present embodiment will be described with reference to FIG. 3. The reset process is a process of setting the number of times of automatic time correction stored in the automatic time correction counter 229 and the automatic time correction frequency memory 230 to an initial value, and is started, for example, if the power of the electronic timepiece 1 is turned on.

If the reset process is started, in STEP S101, the control unit 210 sets 0 in the automatic time correction counter 229. Subsequently, the control unit 210 updates the number of times of automatic time correction stored in the automatic time correction frequency memory 230 with 4 in STEP S102, and finishes the reset process.

By the above-described process, in an initial state, the control unit 210 sets the frequency at which the time correction process should be performed to 4 times per day. However, the frequency at which the time correction process should be performed in the initial state is not limited to 4 times per day, and the number of times can be arbitrarily set.

Figure 4:
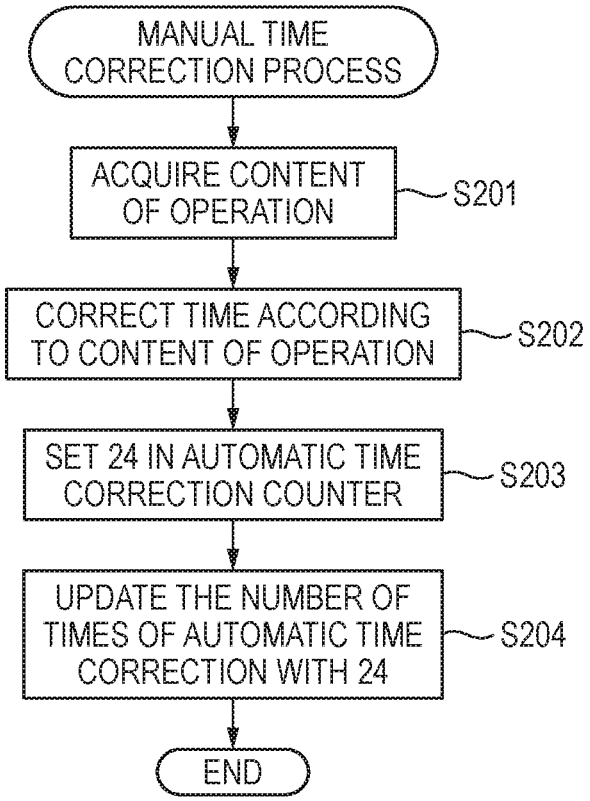
FIG. 4 is a flow chart illustrating the control procedure of a manual time correction process which is performed by the control unit of the electronic timepiece according to the first embodiment.

Now, a manual time correction process of the electronic timepiece 1 according to the present embodiment will be described with reference to FIG. 4. This process is started if the operation member 243 receives a time correction operation from the user.

First, in STEP S201, the control unit 210 acquires the operation content of the time correction operation recognized by the operation member 243. Subsequently, in STEP S202, the control unit 210 corrects the time of the home time stored in the HT date/time memory 223, according to the acquired operation content. Then, in STEP S203, the control unit 210 sets 24 in the automatic time correction counter 229. Subsequently, the control unit 210 updates the automatic time correction frequency memory 230 with 24 in STEP S204, and finishes the process.

After the time correction operation is received, by the above-described process, the control unit 210 increases the number of times per day the time correction process should be performed, from 4 times to 24 times, until the predetermined time (24 hours) elapses. However, the predetermined time is not limited to 24 hours, and an arbitrary time can be set. Also, the frequency at which the time correction process should be performed in the predetermined time is not limited to 24 times per day, and the number of times larger than the number of times in the initial state can be arbitrarily set.

Figure 5:
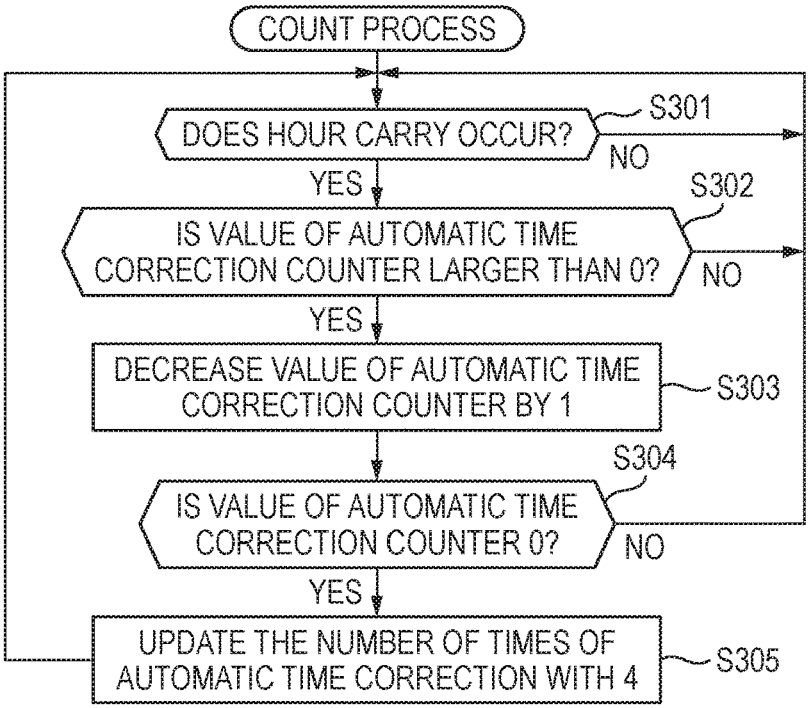
FIG. 5 is a flow chart illustrating the control procedure of a count process which is performed by the control unit of the electronic timepiece according to the first embodiment.

Now, a count process of the electronic timepiece 1 according to the present embodiment will be described with reference to FIG. 5. In order to count 24 hours by the automatic time correction counter 229, the control unit 210 performs the count process if an hour carry (start of a new hour at 1 second from 59 minutes and 59 seconds of each hour) occurs in the course of the clocking process of the electronic timepiece 1.

First, in STEP S301, the control unit 210 determines whether an hour carry (start of a new hour) has occurred. In the case where an hour carry has occurred ("Yes" in STEP S301), in STEP S302, the control unit 210 determines whether the value of the automatic time correction counter 229 is larger than 0. In the case where the value of the automatic time correction counter 229 is larger than 0 ("Yes" in STEP S302), in STEP S303, the control unit 210 decreases the value of the automatic time correction counter 229 by 1.

Subsequently, in STEP S304, the control unit 210 determines whether the value of the automatic time correction counter 229 is 0. In the case where the value of the automatic time correction counter 229 is 0 ("Yes" in STEP S304), in STEP S305, the control unit updates the number of times of automatic time correction stored in the automatic time correction frequency memory 230 with 4. Then, the control unit 210 returns to STEP S301, and stands by until an hour carry occurs.

In the case where an hour carry has not occurred ("No" in STEP S301), and the value of the automatic time correction counter 229 is equal to or smaller than 0 ("No" in STEP S302), and the value of the automatic time correction counter 229 is not 0 ("No" in STEP S304), the control unit 210 returns to STEP S301, and stands by until an hour carry occurs.

By the above-described process, the control unit 210 counts the time elapsed after reception of a time correction operation, in units of one hour, by the automatic time correction counter 229. Also, if 24 hours elapses after reception of a time correction operation, the control unit 210 returns the number of times of automatic time correction to 4 times per day.

Figure 6:
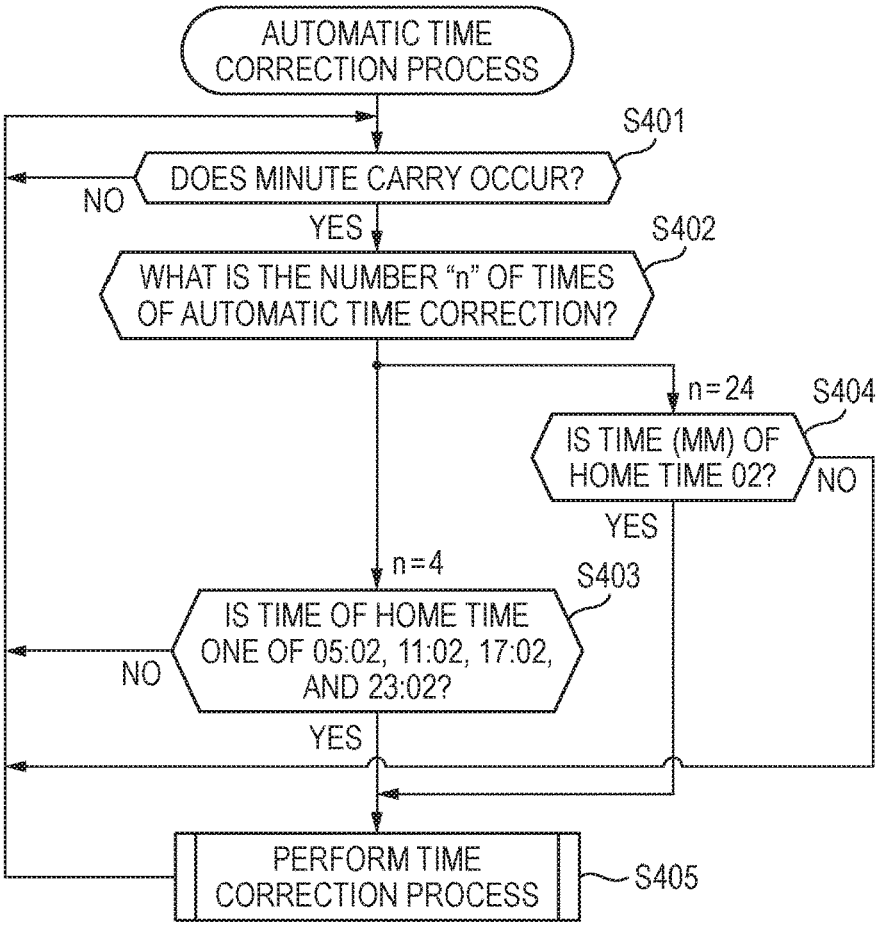
FIG. 6 is a flow chart illustrating the control procedure of an automatic time correction process which is performed by the control unit of the electronic timepiece according to the first embodiment.

Now, the automatic time correction process of the electronic timepiece 1 according to the present embodiment will be described with reference to FIG. 6. This process is a process of accessing the external device at a frequency represented by the number of times of automatic time correction stored in the automatic time correction frequency memory 230 and automatically adjusting the time of the home time of the electronic timepiece 1 to the time (the external time) of the external device.

First, in STEP S401, the control unit 210 determines whether a minute carry (start of a new minute at 1 second from 59 seconds of each minute) has occurred. In the case where a minute carry has occurred ("Yes" in STEP S401), in STEP S402, the control unit 210 determines whether the number "n" of times of automatic time correction stored in the automatic time correction frequency memory 230 is 4 or 24. In the case where a minute carry has not occurred ("No" in STEP S401), the control unit 210 stands by until a minute carry occurs.

In the case where the number "n" of times of automatic time correction is 4 ("n=4" in STEP S402), in STEP S403, the control unit 210 determines whether the time (hours and minutes) of the home time stored in the HT date/time memory 223 is any one of 05:02, 11:02, 17:02, and 23:02. In the case where the time (hours and minutes) of the home time is one of 05:02, 11:02, 17:02, and 23:02 ("Yes" in STEP S403), in STEP S405, the control unit 210 performs the time correction process. In the case where the time (hours and minutes) of the home time is not one of 05:02, 11:02, 17:02, and 23:02 ("No" in STEP S403), the control unit 210 returns to STEP S401, and stands by until a minute carry occurs.

In the case where the number "n" of times of automatic time correction is 24 ("n=24" in STEP S402), in STEP S404, the control unit 210 determines whether the time (minutes) of the home time stored in the HT date/time memory 223 is 02. In the case where the time (minutes) of the home time is 02 ("Yes" in STEP S404), in STEP S405, the control unit 210 performs the time correction process. In the case where the time (minutes) of the home time is not 02 ("No" in STEP S404), the control unit 210 returns to STEP S401, and stands by until a minute carry occurs.

Now, the time correction process of the electronic timepiece 1 according to the present embodiment will be described with reference to FIG. 7. First, in STEP S501, the control unit 210 performs a connection process for establishing a connection with the external device via the communication unit 244.

Subsequently, in STEP S502, the control unit 210 requests the external device to transmit time difference information and daylight saving time (DST) information. If the external device receives that request, it transmits time difference information and daylight saving time (DST) information which the external device has, to the electronic timepiece 1 having requested. Then, in STEP S503, the control unit 210 receives the time difference information and the daylight saving time (DST) information transmitted by the external device, via the communication unit 244.

Subsequently, in STEP S504, the control unit 210 requests the external device to transmit date-and-time information and 1/256-second information, via the communication unit 244. If the external device receives that request, it transmits date-and-time information and 1/256-second information which the external device has, to the electronic timepiece 1 having requested. Then, in STEP S505, the control unit 210 receives the date-and-time information and the 1/256-second information transmitted by the external device, via the communication unit 244.

Subsequently, in STEP S506, the control unit 210 determines whether the value of the automatic time correction counter 229 is 0. In the case where the value of the automatic time correction counter 229 is not 0 ("No" in STEP S506), in STEP S507, the control unit determines whether the absolute value of the difference between the date and time of the home time stored in the HT date/time memory 223 and the received date and time is 7.5 minutes or less, or not. In the case where the absolute value is not 7.5 minutes or less ("No" in STEP S507), the control unit proceeds to STEP S510.

In the case where the value of the automatic time correction counter 229 is 0 ("Yes" in STEP S506), or in the case where the absolute value of the difference between the date and time of the home time stored in the HT date/time memory 223 and the received date and time is 7.5 minutes or less ("Yes" in STEP S507), in STEP S508, the control unit 210 updates the 1/256-second memory 227 with the received 1/256-second information, and updates the HT date/time memory 223 with the received date and time, and updates the HT_DST memory 222 with the received daylight saving time information, and updates the HT time difference memory 221 with the received time difference.

Next, in STEP S509, the control unit 210 calculates Coordinated Universal Time (UTC) by subtracting the time difference stored in the HT time difference memory 221 and the daylight saving time information stored in the HT_DST memory 222 from the date and time of the home time stored in the HT date/time memory 223, and obtains the date and time of the dual time by adding the time difference stored in the DT time difference memory 224 and the daylight saving time information stored in the DT_DST memory 225 to the Coordinated Universal Time (UTC), and stores the obtained date and time in the DT date/time memory 226. Then, the control unit 210 performs a disconnection process for terminating the connection with the external device, in STEP S510, and returns to STEP S401 of FIG. 6.

In the case where the frequency at which the time correction process should be performed has been set to 4 times per day, by the above-described process, the control unit 210 accesses the external device once every 6 hours, and corrects the time of the home time to an external time received from the external device. Also, in the case where the frequency at which the time correction process should be performed has been set to 24 times per day, the control unit 210 accesses the external device once every hour, and corrects the time of the home time to an external time received from the external device. In the above-described example, in the case where the number of times of automatic time correction per day is 4, 05:02, 11:02, 17:02, and 23:02 every day are set as timings at which the time correction process should be performed; whereas in the case where the number of times of automatic time correction per day is 24, 02 minutes past the hour are set as timings at which the time correction process should be performed.

However, timings at which the time correction process should be performed may be arbitrarily set. By the way, at 00 minutes past the hour, the electronic timepiece 1 is likely to be in a state where it should perform many processes due to time signal processing. For this reason, it is preferable to set timings at which the time correction process should be performed to timings other than 00 minutes past the hour.

As described above, after the operation member 243 receives a time correction operation, the control unit 210 of the electronic timepiece 1 according to the present embodiment sets a frequency at which the time correction process should be performed, higher than that before the reception of the time correction operation, until the predetermined time elapses. Therefore, after the user manually corrects the time of the electronic timepiece 1, even if the user moves to another time zone, it is possible to quickly correct the time of the electronic timepiece 1 to a time suitable for the user. Also, if the predetermined time elapses after reception of a time correction operation, the control unit 210 of the electronic timepiece 1 sets the original frequency again. Therefore, it is possible to suppress power consumption from increasing due to the time correction process.

Also, in the present embodiment, the operation member 243 receives an operation for correcting the time clocked by the counter 241 to a time designated by the user, as a time correction operation. Therefore, after the time clocked by the counter 241 is corrected to a time designated by the user, even if the user moves to another time zone, it is possible to quickly correct the time of the electronic timepiece to a time suitable for the user.

Second Embodiment

In the first embodiment, the example in which the control unit increases the frequency at which the time correction process should be performed for the predetermined time if the user manually corrects the time of the home time of the electronic timepiece 1 has been described as an example. In the second embodiment, an example in which the control unit changes the frequency at which the time correction process should be performed if the user manually performs correction to a city corresponding to the time difference of the home time of the electronic timepiece 1 from Coordinated Universal Time (UTC) will be described. In the following description, components identical to those of the first embodiment are denoted by the same reference symbols, and a detailed description thereof will not be made.

Figure 8:
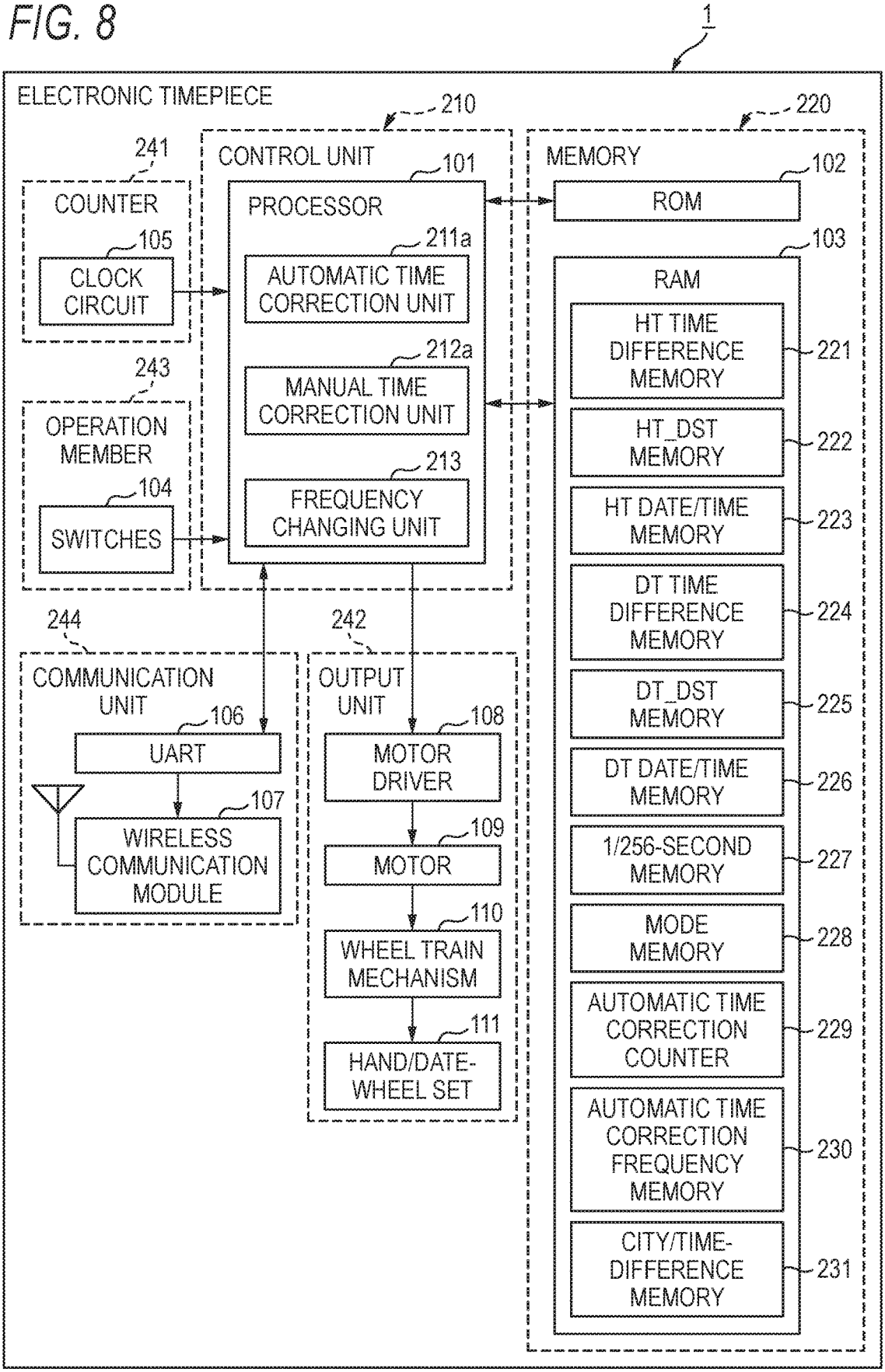
FIG. 8 is a block diagram illustrating the configuration of an electronic timepiece according to a second embodiment.

The functional configuration of an electronic timepiece 1 according to the second embodiment will be described. As shown in FIG. 8, in the electronic timepiece 1, the memory 220 further includes a city/time-difference memory 231 for storing the correspondence relation between cities and time differences, in addition to the components of the memory 220 of the first embodiment shown in FIG. 2. Also, the control unit 210 functions as an automatic time correction unit 211*a* and a manual time correction unit 212*a*, instead of the automatic time correction unit 211 and the manual time correction unit 212 of the first embodiment.

FIG. 9 shows examples of data items which are stored in the city/time-difference memory 231. As shown in FIG. 9, in the city/time-difference memory 231, city codes representing cities, and time differences of the times in the corresponding cities from Coordinated Universal Time (UTC) are stored in association with each other.

The control unit 210 which functions as the automatic time correction unit 211*a* performs the time correction process of correcting the time clocked by the counter 241. In the present embodiment, at the frequency stored in the automatic time correction frequency memory 230 to be described below, the control unit 210 receives the time (external time) of the external device such as a smart phone and the time difference from Coordinated Universal Time (UTC) by communication with the external device via the communication unit 244. If the time difference received by the communication unit 244 is the same as the time difference stored in the HT time difference memory 221, the control unit 210 corrects the time of the home time stored in the memory 220 to the external time.

If the operation member 243 receives a user's city correction operation for performing correction to a city corresponding to the time clocked by the counter 241, on the basis of the corrected city, the control unit 210 which functions as the manual time correction unit 212*a* corrects the time difference of the home time stored in the HT time difference memory 221, and the date and time of the home time stored in the HT date/time memory 223. In the present embodiment, the control unit 210 specifies a time difference corresponding to a city code representing the city received by the operation member 243, with reference to the city/time-difference memory 231, and corrects the time difference stored in the HT time difference memory 221 to the specified time difference.

Figure 10:
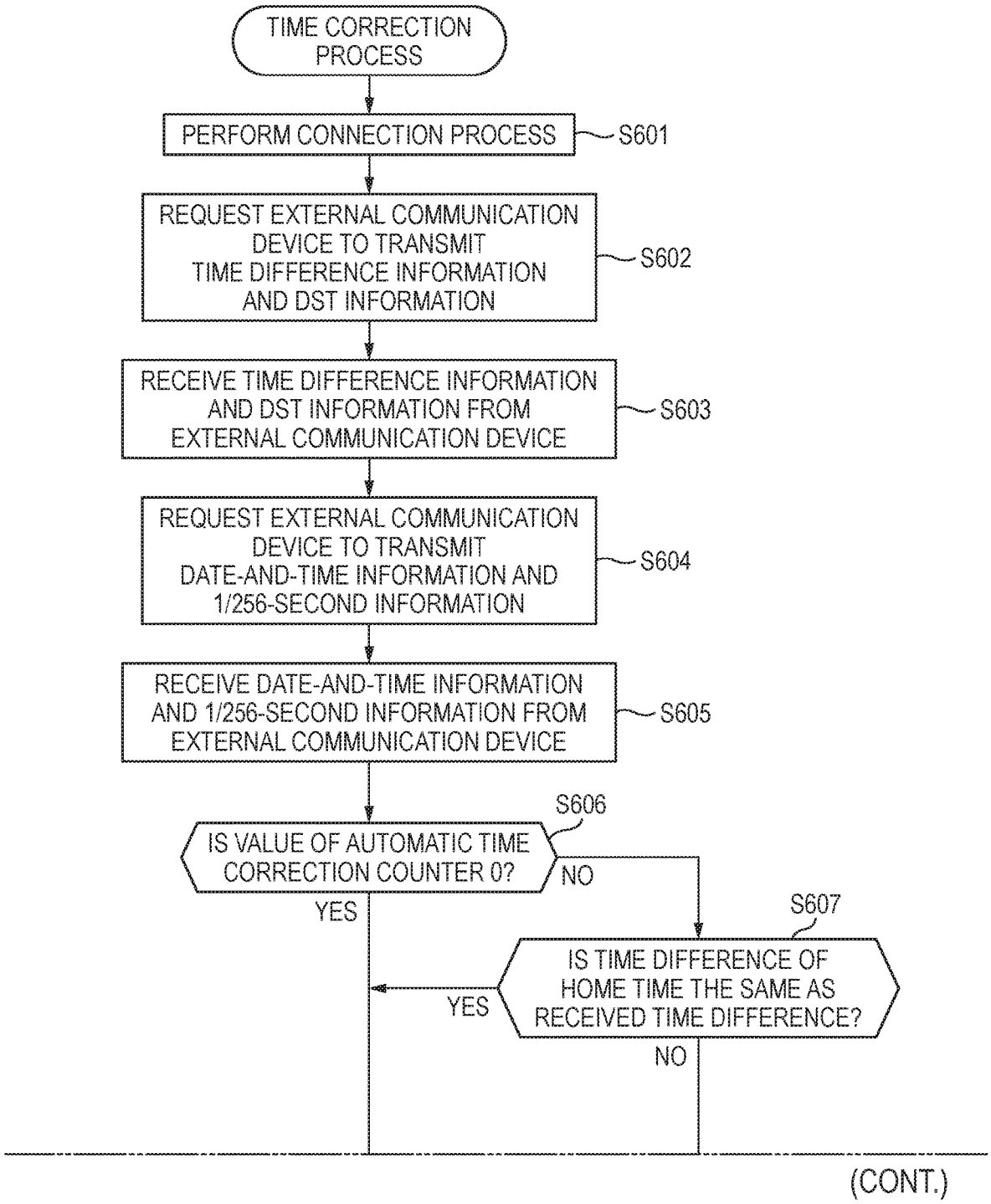
FIG. 10 is a flow chart illustrating the control procedure of a time correction process which is performed by a control unit of the electronic timepiece according to the second embodiment.

Now, the time correction process of the electronic timepiece 1 according to the present embodiment will be described with reference to FIG. 10. The control unit 210 performs processes identical to STEPS S501 to S506 and STEPS S508 to S510 of the time correction process according to the first embodiment shown in FIG. 7, in STEPS S601 to S606 and STEPS S608 to S610.

Also, in STEP S607, the control unit 210 determines whether the time difference of the home time stored in the HT time difference memory 221 is the same as the received time difference. In the case of determining that the time difference of the home time is the same as the received time difference, the control unit 210 proceeds to STEP S608. Meanwhile, in the case of determining that the time difference of the home time is not the same as the received time difference, the control unit 210 proceeds to STEP S610.

Also, in the above-described process, if the operation member 243 receives a user's operation of designating a city, the control unit 210 may store a city code corresponding to the designated city, in the memory 220. Further, the control unit 210 may receive the time (external time) and a city code of an external device such as a smart phone by communication with the external device via the communication unit 244. In this case, in STEP S607, the control unit 210 determines whether the city code stored in the memory 220 is the same as the received city code. In the case where they are the same as each other, the control unit proceeds to STEP S608; whereas in the case where they are not the same as each other, the control unit proceeds to STEP S610.

As described above, if the operation member 243 receives a city correction operation for performing correction to a city corresponding to the time difference of the home time of the electronic timepiece 1 from Coordinated Universal Time (UTC), the control unit 210 of the electronic timepiece 1 according to the present embodiment sets a frequency at which the time correction process should be performed, higher than that before the reception of the city correction operation, until the predetermined time elapses. Therefore, after the user manually performs correction to a city corresponding to the time difference of the home time of the electronic timepiece 1, even if the user moves to another time zone, it is possible to quickly perform correction to a time suitable for the user. Also, if the predetermined time elapses from reception of a city correction operation, the control unit 210 sets the original frequency again. Therefore, it is possible to suppress power consumption from increasing due to the time correction process.

Third Embodiment

In the first embodiment, the example in which the operation member 243 receives an operation for correcting the time clocked by the counter 241 to a time designated by the user as a time correction operation has been described. However, the operation member 243 may receive an operation (a time connection operation) for receiving an external time from an external device and correcting the time clocked by the counter 241 to the received external time, as a time correction operation.

Figure 11:
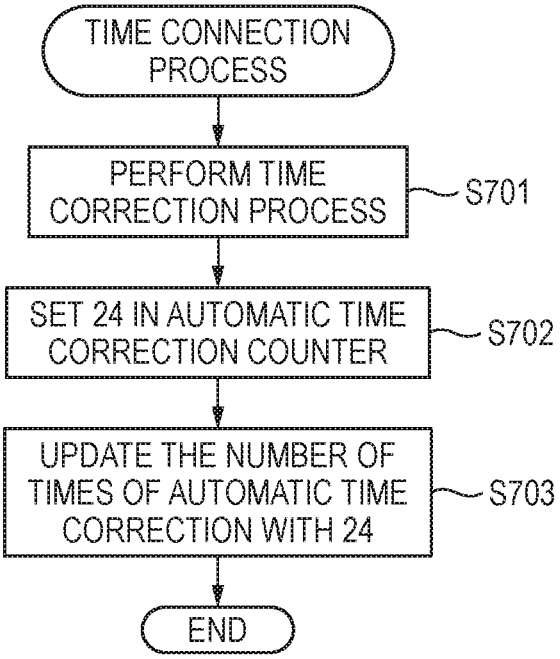
FIG. 11 is a flow chart illustrating the control procedure of a time connection process which is performed by a control unit of an electronic timepiece according to a third embodiment.

A time connection process of an electronic timepiece 1 according to the present embodiment will be described with reference to FIG. 11. This process is started if the operation member 243 receives a time connection operation from the user.

Figure 7:
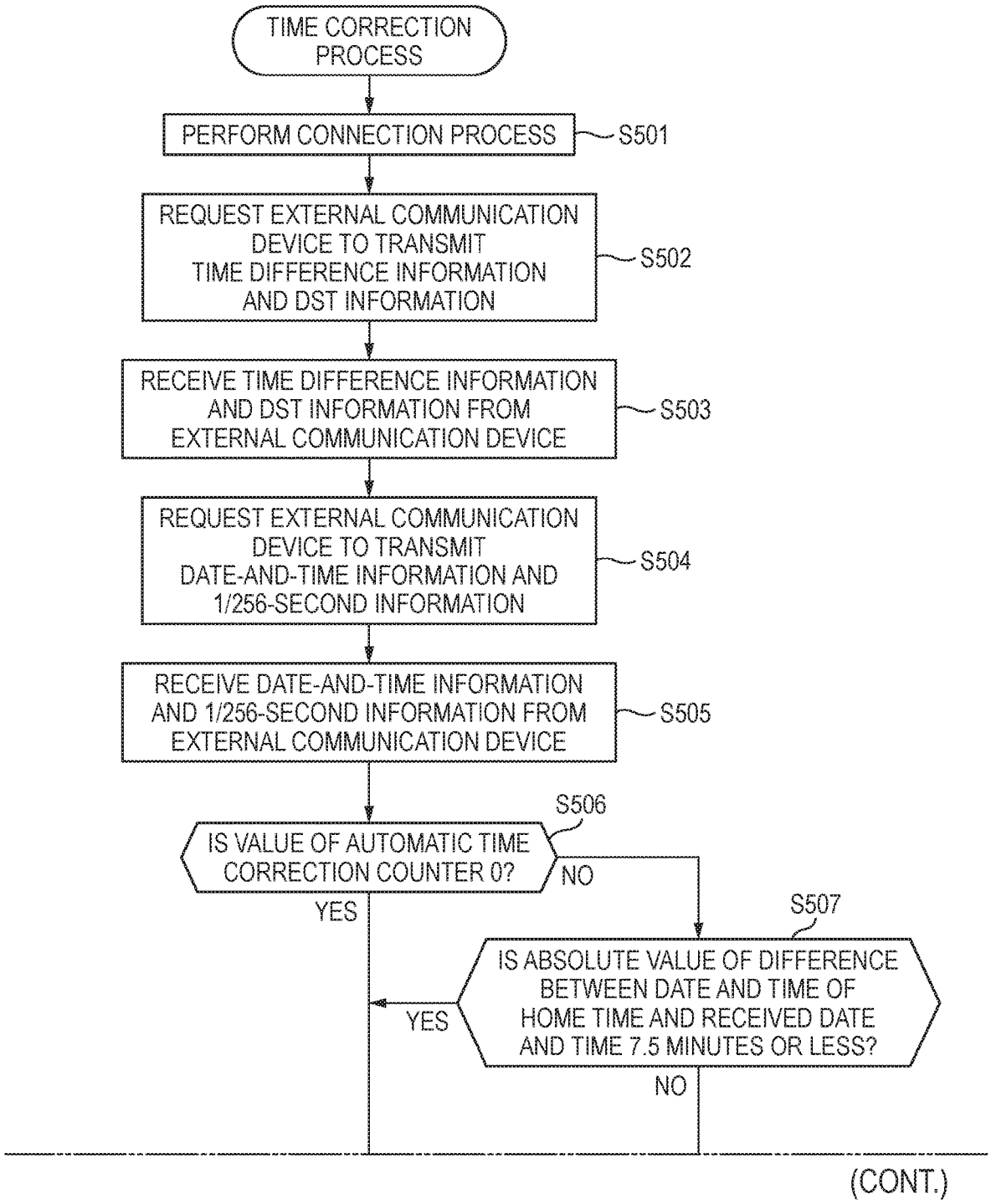
FIG. 7 is a flow chart illustrating the control procedure of a time correction process which is performed by the control unit of the electronic timepiece according to the first embodiment.

If the operation member 243 receives a time correction operation, first, in STEP S701, the control unit 210 performs the time correction process shown in FIG. 7. Next, in STEP S702, the control unit 210 sets 24 in the automatic time correction counter 229. Subsequently, the control unit 210 updates the automatic time correction frequency memory 230 with 24 STEP S703, and finishes the process.

By the above-described process, if a time connection operation is received, the control unit 210 increases the number of times per day the control unit should perform the time correction process, from 4 times to 24 times until the predetermined time (24 hours) elapses. Therefore, after the time connection process is performed, even if the user moves to another time zone, it is possible to quickly perform correction to a time suitable for the user. Also, if the predetermined time elapses from reception of a time connection operation, the control unit 210 of the electronic timepiece 1 sets the original frequency again. Therefore, it is possible to suppress power consumption from increasing due to the time correction process.

Fourth Embodiment

In the first embodiment to the third embodiment described above, the example in which if a time correction operation or a city correction operation is received, the control unit increases the frequency at which the time correction process should be performed until the predetermined time elapses has been described. In the present embodiment, in the case where the communication unit 244 receives a constant time difference for a time longer than the predetermined time, the control unit sets a frequency at which the time correction process should be performed, lower than that before reception of the time correction operation or the city correction operation will be described.

Figure 12:
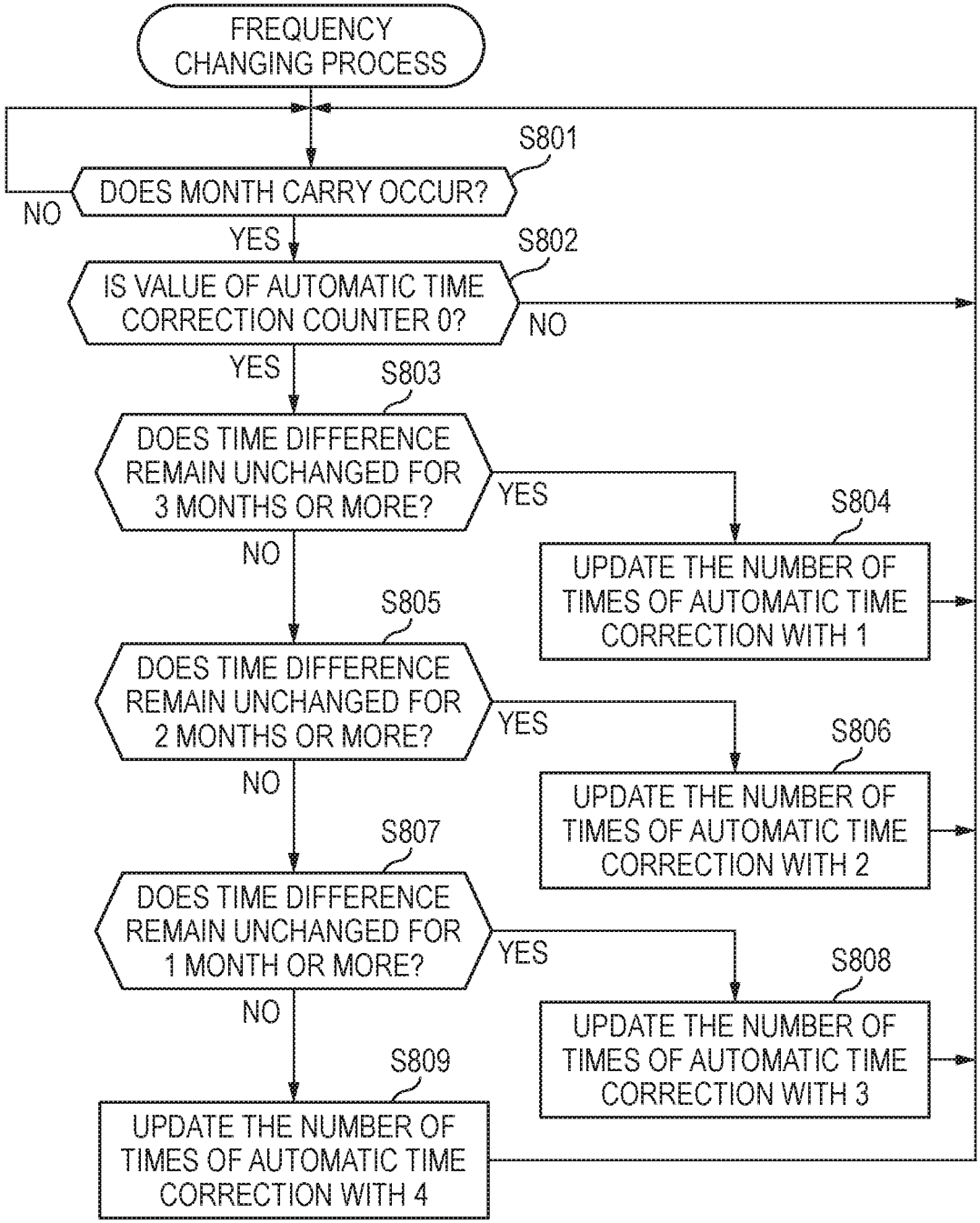
FIG. 12 is a flow chart illustrating the control procedure of a frequency changing process which is performed by a control unit of an electronic timepiece according to a fourth embodiment.

A frequency changing process of an electronic timepiece 1 according to the present embodiment will be described with reference to FIG. 12. The control unit 210 performs the frequency changing process when a month carry (start of a new month at 1 second from 23:59:59 on the last day of each month) occurs in the course of the clocking process of the electronic timepiece 1.

First, in STEP S801, the control unit 210 determines whether a month carry (start of a new month) has occurred. In the case where a month carry has occurred ("Yes" in STEP S801), in STEP S802, the control unit 210 determines whether the value of the automatic time correction counter 229 is 0. In the case where a month carry has not occurred ("No" in STEP S801), or in the case where the value of the automatic time correction counter 229 is not 0 ("No" in STEP S802), the control unit 210 returns to STEP S801.

In the case where the value of the automatic time correction counter 229 is 0 ("Yes" in STEP S802), in STEP S803, the control unit 210 determines whether the time difference stored in the HT time difference memory 221 has remained unchanged for 3 months or more. In the case where the time difference stored in the HT time difference memory 221 has remained unchanged for 3 months or more ("Yes" in STEP S803), the control unit 210 updates the number of times of automatic time correction stored in the automatic time correction frequency memory 230 with 1 in STEP S804, and returns to STEP S801.

In the case where the time difference stored in the HT time difference memory 221 has not remained unchanged for 3 months or more ("No" in STEP S803), in STEP S805, the control unit 210 determines whether the time difference stored in the HT time difference memory 221 has remained unchanged for 2 months or more. In the case where the time difference stored in the HT time difference memory 221 has remained unchanged for 2 months or more ("Yes" in STEP S805), the control unit 210 updates the number of times of automatic time correction stored in the automatic time correction frequency memory 230 with 2 in STEP S806, and returns to STEP S801.

In the case where the time difference stored in the HT time difference memory 221 has not remained unchanged for 2 months or more ("No" in STEP S805), in STEP S807, the control unit 210 determines whether the time difference stored in the HT time difference memory 221 has remained unchanged for 1 month or more. In the case where the time difference stored in the HT time difference memory 221 has remained unchanged for 1 month or more ("Yes" in STEP S807), the control unit 210 updates the number of times of automatic time correction stored in the automatic time correction frequency memory 230 with 3 in STEP S808, and returns to STEP S801.

In the case where the time difference stored in the HT time difference memory 221 has not remained unchanged for 1 month or more ("No" in STEP S807), the control unit 210 updates the number of times of automatic time correction stored in the automatic time correction frequency memory 230 with 4 in STEP S809, and returns to STEP S801.

By the above-described process, after the time difference stored in the HT time difference memory 221 is finally changed, whenever one month passes, the control unit 210 decreases the number of times the time correction process should be performed by 1, thereby decreasing the frequency. Further, after the time difference stored in the HT time difference memory 221 is finally changed, if 3 months pass, the control unit 210 sets the frequency at which the time correction process should be performed, to once per day.

Now, an automatic time correction process of the electronic timepiece 1 according to the present embodiment will be described with reference to FIG. 13. The control unit 210 performs processes identical to STEPS S401 to S405 of the automatic time correction process shown in FIG. 6, in STEPS S901, S902, and S906 to S908, and further performs the following processes of STEPS S903 to S905.

In the case where the number "n" of times of automatic time correction is 1 ("n=1" in STEP S902), in STEP S903, the control unit 210 determines whether the time (HH:MM) of the home time stored in the HT date/time memory 223 is 17:02. In the case where the time (HH:MM) of the home time is 17:02 ("Yes" in STEP S903), in STEP S908, the control unit performs the time correction process. In the case where the time (HH:MM) of the home time is not 17:02 ("No" in STEP S903), the control unit 210 returns to STEP S901, and stands by until a minute carry occurs.

In the case where the number "n" of times of automatic time correction is 2 ("n=2" in STEP S902), in STEP S904, the control unit 210 determines whether the time (HH:MM) of the home time stored in the HT date/time memory 223 is one of 11:02 and 23:02. In the case where the time (HH:MM) of the home time is 11:02 or 23:02 ("Yes" in STEP S904), in STEP S908, the control unit performs the time correction process. In the case where the time (HH:MM) of the home time is not 11:02 or 23:02 ("No" in STEP S904), the control unit 210 returns to STEP S901, and stands by until a minute carry occurs.

In the case where the number "n" of times of automatic time correction is 3 ("n=3" in STEP S902), in STEP S905, the control unit 210 determines whether the time (HH:MM) of the home time stored in the HT date/time memory 223 is one of 00:02, 08:02, and 16:02. In the case where the time (HH:MM) of the home time is one of 00:02, 08:02, and 16:02 ("Yes" in STEP S905), in STEP S908, the control unit performs the time correction process. In the case where the time (HH:MM) of the home time is not one of 00:02, 08:02, and 16:02 ("No" in STEP S905), the control unit 210 returns to STEP S901, and stands by until a minute carry occurs.

As described above, after the time difference stored in the HT time difference memory 221 is changed, as time goes on, the control unit 210 decreases the frequency at which the time correction process should be performed. Therefore, for a user who does not frequently change the time difference, in other words, for a user who does not frequently moves from a time zone to another time zone, the electronic timepiece 1 sets a low frequency at which the time correction process should be performed. Therefore, it is possible to further suppress the power consumption of the electronic timepiece 1.

Fifth Embodiment

Figure 14:
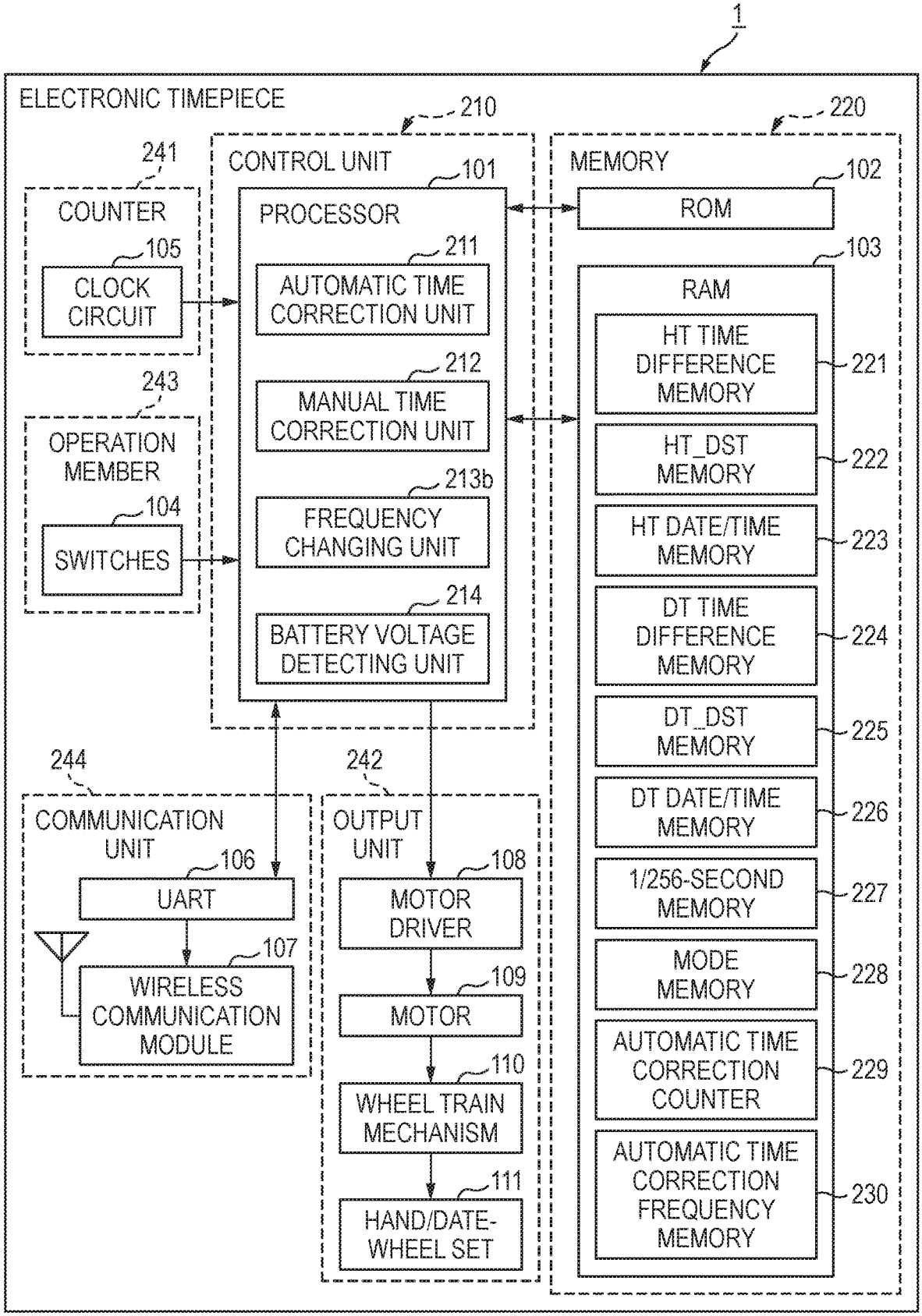
FIG. 14 is a block diagram illustrating the functional configuration of an electronic timepiece according to a fifth embodiment.

The electronic timepiece 1 according to any one of the first embodiment to the fourth embodiment may be configured to detect the voltage of a battery configured to supply power to the electronic timepiece 1 and decrease the frequency at which the time correction process should be performed as the detected voltage decreases. Hereinafter, the functional configuration of an electronic timepiece 1 according to a fifth embodiment will be described. As shown in FIG. 14, in the electronic timepiece 1, the control unit 210 functions as a frequency changing unit 213*b*, instead of the frequency changing unit 213 of the first embodiment. Also, the control unit 210 further functions as a battery voltage detecting unit 214.

The control unit 210 which functions as the battery voltage detecting unit 214 detects the voltage (battery voltage) of a battery (not shown in the drawings) configured to supply power to the electronic timepiece 1. As the battery voltage detected by the battery voltage detecting unit 214 decreases, the frequency changing unit 213*b* decreases the frequency at which the time correction process should be performed. In the present embodiment, in the case where the detected battery voltage is lower than a threshold V1 (the case where the battery voltage is a second low level), the frequency changing unit 213*b* does not perform the time correction process, in other words, the frequency changing unit sets the frequency at which the time correction process should be performed to zero times per day. Meanwhile, in the case where the detected battery voltage is equal to or higher than the threshold V1 and is lower than a threshold V2 (V1<V2) (the case where the battery voltage is at a first low level), the frequency changing unit 213*b* sets the frequency at which the time correction process should be performed to once per day. Also, in the case where the detected battery voltage is equal to or higher than the threshold V2 (the case where the battery voltage is at a middle level or a high level), the frequency changing unit 213*b* sets the frequency at which the time correction process should be performed to 4 times per day.

Figure 15:
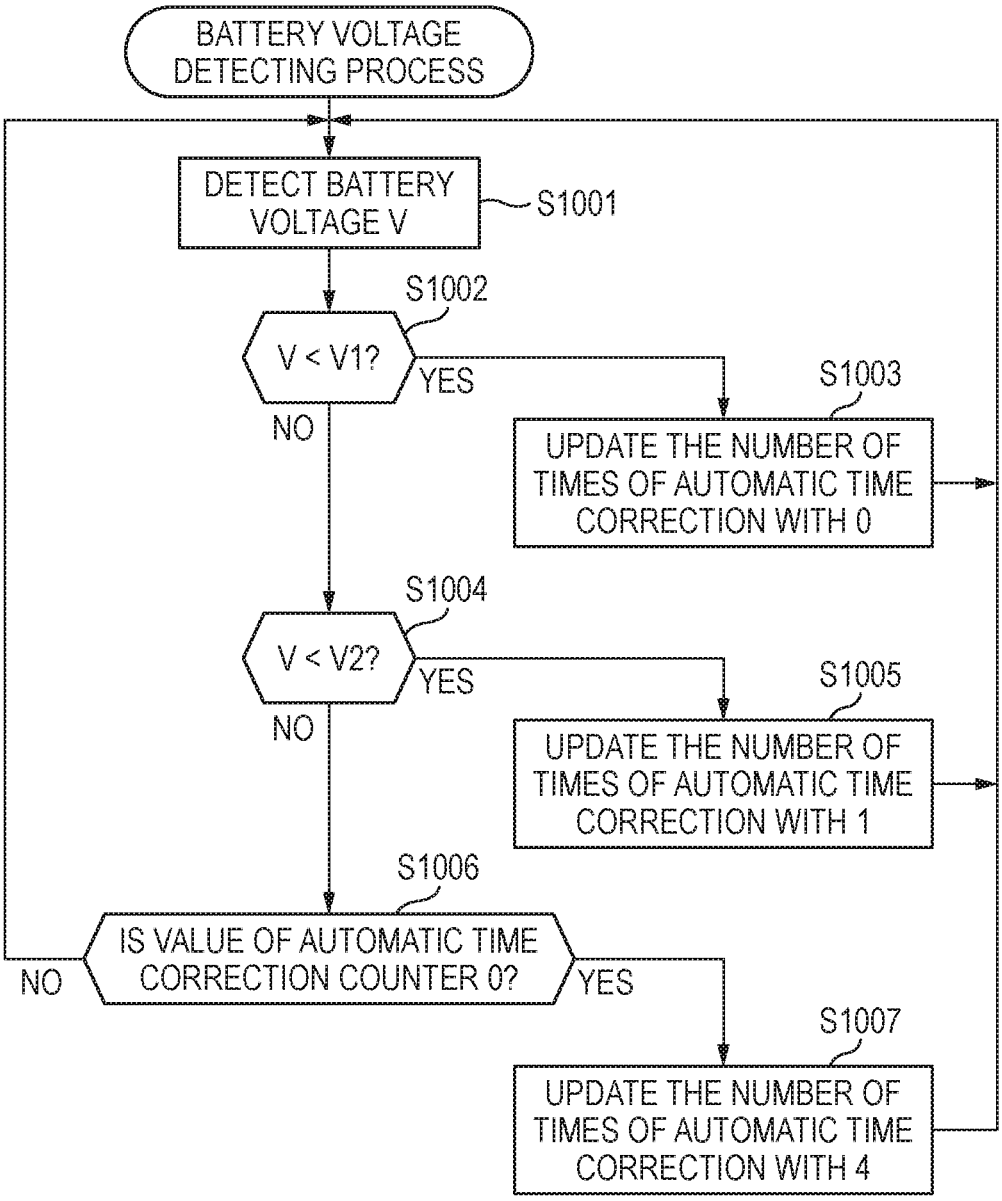
FIG. 15 is a flow chart illustrating the control procedure of a battery voltage detecting process which is performed by a control unit of the electronic timepiece according to the fifth embodiment.

Now, a battery voltage detecting process of the electronic timepiece 1 according to the present embodiment will be described with reference to FIG. 15. The control unit 210 performs the battery voltage detecting process, for example, if the power of the electronic timepiece 1 is turned on.

First, in STEP S1001, the control unit 210 detects the voltage of the battery of the electronic timepiece. Subsequently, in STEP S1002, the control unit 210 determines whether the detected battery voltage is lower than the threshold V1. In the case where the detected battery voltage is lower than the threshold V1 ("Yes" in STEP S1002), in STEP S1003, the control unit 210 updates the number of times of automatic time correction stored in the automatic time correction frequency memory 230 with 0. Then, the control unit 210 returns to STEP S1001.

In the case where the detected battery voltage is equal to or higher than the threshold V1 ("No" in STEP S1002), in STEP S1004, the control unit 210 determines whether the detected battery voltage is lower than the threshold V2. In the case where the detected battery voltage is lower than the threshold V2 ("Yes" in STEP S1004), in STEP S1005, the control unit 210 updates the number of times of automatic time correction stored in the automatic time correction frequency memory 230 with 1. Then, the control unit 210 returns to STEP S1001.

In the case where the detected battery voltage is equal to or higher than the threshold V2 ("No" in STEP S1004), in STEP S1006, the control unit 210 determines whether the value of the automatic time correction counter 229 is 0. In the case where the value of the automatic time correction counter 229 is 0 ("Yes" in STEP S1006), in STEP S1007, the control unit 210 updates the number of times of automatic time correction stored in the automatic time correction frequency memory 230 with 4. Then, the control unit 210 returns to STEP S1001. Meanwhile, in the case where the value of the automatic time correction counter 229 is not 0 ("No" in STEP S1006), the control unit 210 returns to STEP S1001.

Now, the automatic time correction process of the electronic timepiece 1 according to the present embodiment will be described with reference to FIG. 16. The control unit 210 performs processes identical to STEPS S401 to S405 of the automatic time correction process shown in FIG. 6 in STEPS S1101, S1102, and S1104 to S1106, and further performs the following process of STEP 1103.

In the case where the number "n" of times of automatic time correction is 0 ("n=0" in STEP S1102), the control unit 210 returns to STEP S1101.

In the case where the number "n" of times of automatic time correction is 1 ("n=1" in STEP S1102), in STEP S1103, the control unit 210 determines whether the time (HH:MM) of the home time stored in the HT date/time memory 223 is 17:02. In the case where the time (HH:MM) of the home time is 17:02 ("Yes" in STEP S1103), in STEP S1106, the control unit performs the time correction process. In the case where the time (HH:MM) of the home time is not 17:02 ("No" in STEP S1103), the control unit 210 returns to STEP S1101.

As described above, as the detected battery voltage of the electronic timepiece 1 decreases, the control unit 210 decreases the frequency at which the time correction process should be performed. Therefore, in the case where the battery voltage of the electronic timepiece 1 is low, it is possible to further suppress the power consumption of the electronic timepiece 1.

Sixth Embodiment

Figure 17:
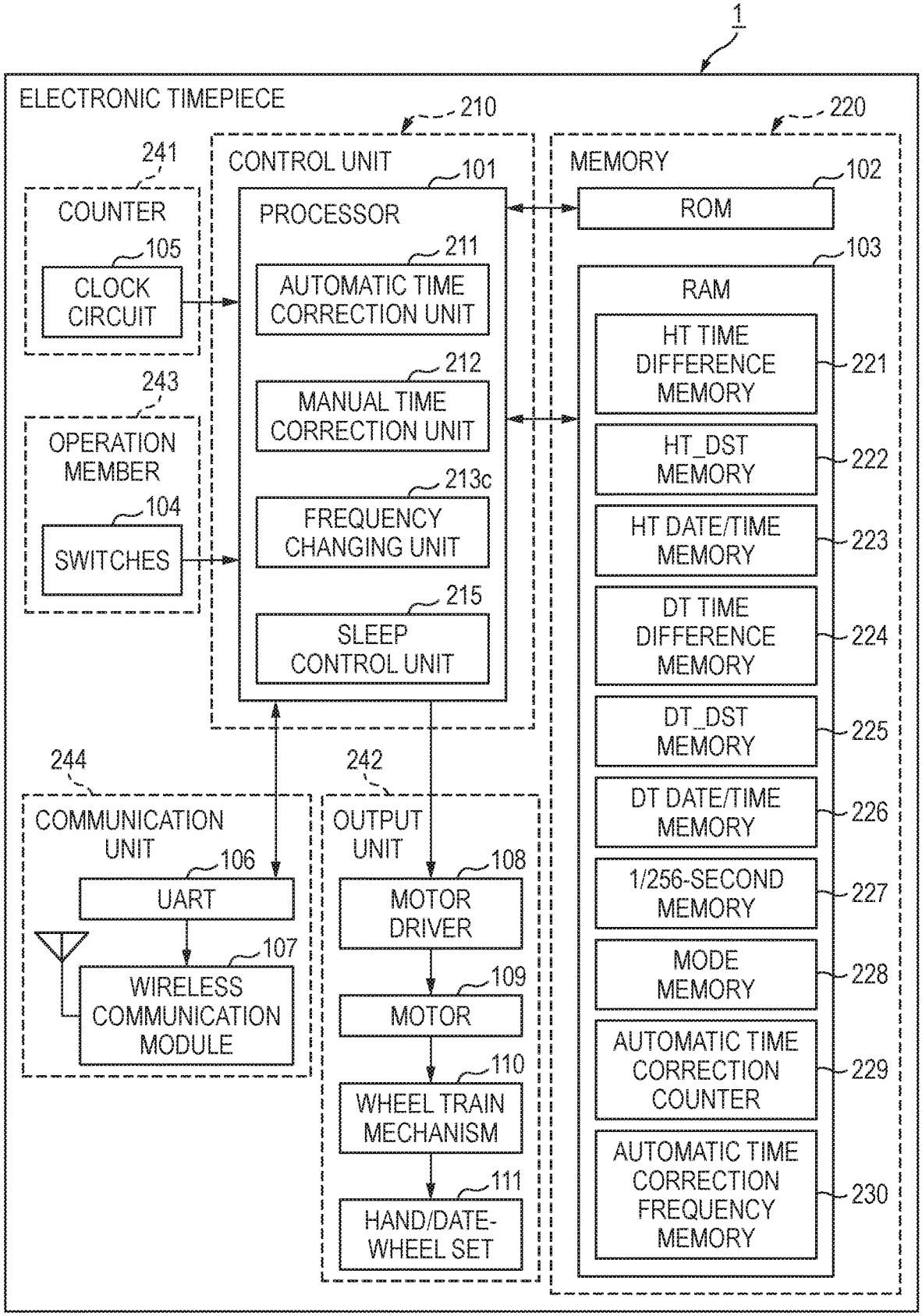
FIG. 17 is a block diagram illustrating the functional configuration of an electronic timepiece according to a sixth embodiment.

The electronic timepiece 1 according to any one of the first embodiment to the fifth embodiment may be configured to decrease the frequency at which the time correction process should be performed as the duration of a sleep state in which a predetermined operation is not performed is long and lengthens and perform the time correction process if the electronic timepiece is released from the sleep state. Hereinafter, the functional configuration of an electronic timepiece 1 according to a sixth embodiment will be described. As shown in FIG. 17, in the electronic timepiece 1, the control unit 210 functions as a frequency changing unit

213*c*, instead of the frequency changing unit 213 of the first embodiment. Also, the control unit 210 further functions as a sleep control unit 215.

The control unit 210 which functions as the sleep control unit 215 controls the sleep state in which the predetermined operation is not performed. In the present embodiment, the electronic timepiece 1 includes, for example, a brightness sensor (not shown in the drawings) configured to detect the ambient brightness of the electronic timepiece 1, and the control unit 210 determines whether the brightness detected by the brightness sensor is equal to or larger than a predetermined value, or not, in other words, whether the electronic timepiece 1 is being used. If a state where the brightness detected by the brightness sensor is smaller than the predetermined value, i.e. a state where the electronic timepiece 1 is not being used continues for a predetermined time (for example, 1 hour), the control unit 210 switches the electronic timepiece to the sleep state in which the second hand is not operated. Further, if the sleep state continues for a predetermined period (for example, 1 week), the control unit 210 switches the electronic timepiece to a complete sleep state in which all hands are not operated. Furthermore, in the sleep state or the complete sleep state, if the brightness detected by the brightness sensor is equal to or larger than the predetermined value, in other words, if it is determined that the electronic timepiece 1 is being used, the control unit 210 releases the sleep state or the complete sleep state, and operates all hands.

The control unit 210 which functions as the frequency changing unit 213*c* decreases the frequency at which the time correction process should be performed as the period of the sleep state is long, and performs the time correction process if the electronic timepiece is released from the sleep state. In the present embodiment, if the electronic timepiece transitions to the sleep state, the control unit 210 sets the frequency at which the time correction process should be performed to once per day, and if the electronic timepiece transitions to the complete sleep state, the control unit sets the frequency at which the time correction process should be performed to zero times per day. Also, if the sleep state or the complete sleep state is released, the control unit 210 performs the time correction process, and sets the frequency at which the time correction process should be performed thereafter, to 4 times per day.

Figure 18:
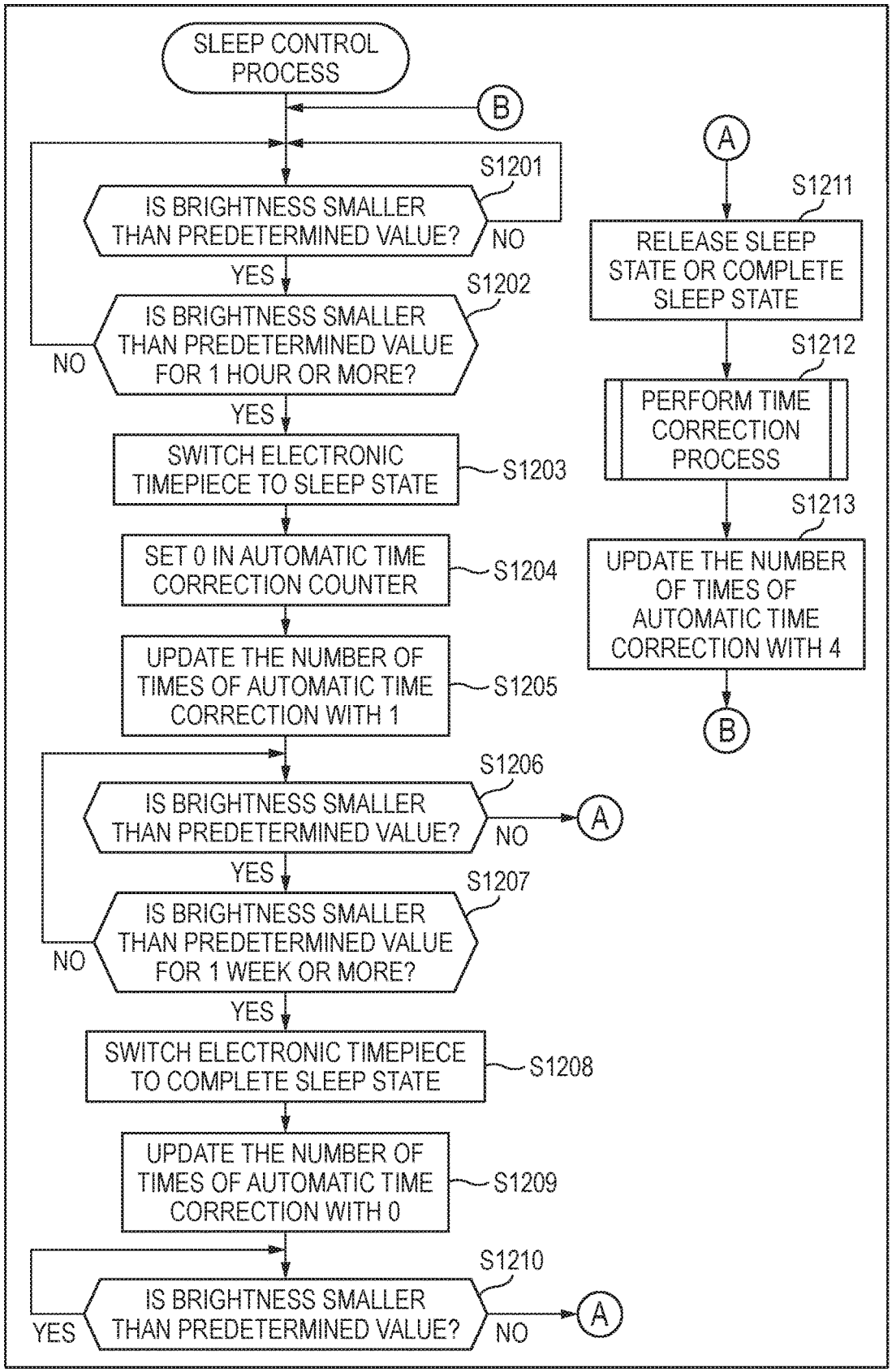
FIG. 18 is a flow chart illustrating the control procedure of a sleep control process which is performed by a control unit of the electronic timepiece according to the sixth embodiment.

Now, a sleep control process of the electronic timepiece 1 according to the present embodiment will be described with reference to FIG. 18. The control unit 210 performs the sleep control process, for example, if the power of the electronic timepiece 1 is turned on.

First, in STEP S1201, the control unit 210 determines whether the detected ambient brightness of the electronic timepiece 1 is smaller than the predetermined value. In the case where the detected brightness is smaller than the predetermined value ("Yes" in STEP S1201), in STEP S1202, the control unit determines whether the detected brightness has been smaller than the predetermined value for 1 hour or more. Meanwhile, in the case where the brightness is equal to or larger than the predetermined value ("No" in STEP S1201), or in the case where the detected brightness has not been smaller than the predetermined value for 1 hour or more ("No" in STEP S1202), the control unit 210 returns to STEP S1201.

In the case where the detected brightness has been smaller than the predetermined value for 1 hour or more ("Yes" in STEP S1202), in STEP S1203, the control unit 210 switches the electronic timepiece to the sleep state. Subsequently, in STEP S1204, the control unit 210 sets 0 in the automatic time correction counter 229. Also, in STEP S1205, the control unit 210 updates the number of times of automatic time correction stored in the automatic time correction frequency memory 230 with 1.

Subsequently, in STEP S1206, the control unit 210 determines whether the detected ambient brightness of the electronic timepiece 1 is smaller than the predetermined value. In the case where the detected brightness is equal to or larger than the predetermined value ("No" in STEP S1206), the control unit 210 proceeds to STEP S1211. In the case where the detected brightness is smaller than the predetermined value ("Yes" in STEP S1206), in STEP S1207, the control unit determines whether the detected brightness has been smaller than the predetermined value for 1 week or more. In the case where the detected brightness has not been smaller than the predetermined value for 1 week or more ("No" in STEP S1207), the control unit 210 returns to STEP S1206.

In the case where the detected brightness has been smaller than the predetermined value for 1 week or more ("Yes" in STEP S1207), in STEP S1208, the control unit 210 switches the electronic timepiece to the complete sleep state. Then, in STEP S1209, the control unit 210 updates the number of times of automatic time correction stored in the automatic time correction frequency memory 230, with 0.

Subsequently, in STEP S1210, the control unit 210 determines whether the detected ambient brightness of the electronic timepiece 1 is smaller than the predetermined value. In the case where the detected brightness is equal to or larger than the predetermined value ("No" in STEP S1210), the control unit 210 proceeds to STEP S1211. In the case where the detected brightness is smaller than the predetermined value ("Yes" in STEP S1210), the control unit 210 stands by.

Then, the control unit 210 releases the sleep state or the complete sleep state in STEP S1211, and performs the time correction process in STEP S1212. Subsequently, the control unit 210 updates the number of times of automatic time correction stored in the automatic time correction frequency memory 230 with 4 in STEP S1213, and returns to STEP S1201.

Figure 16:
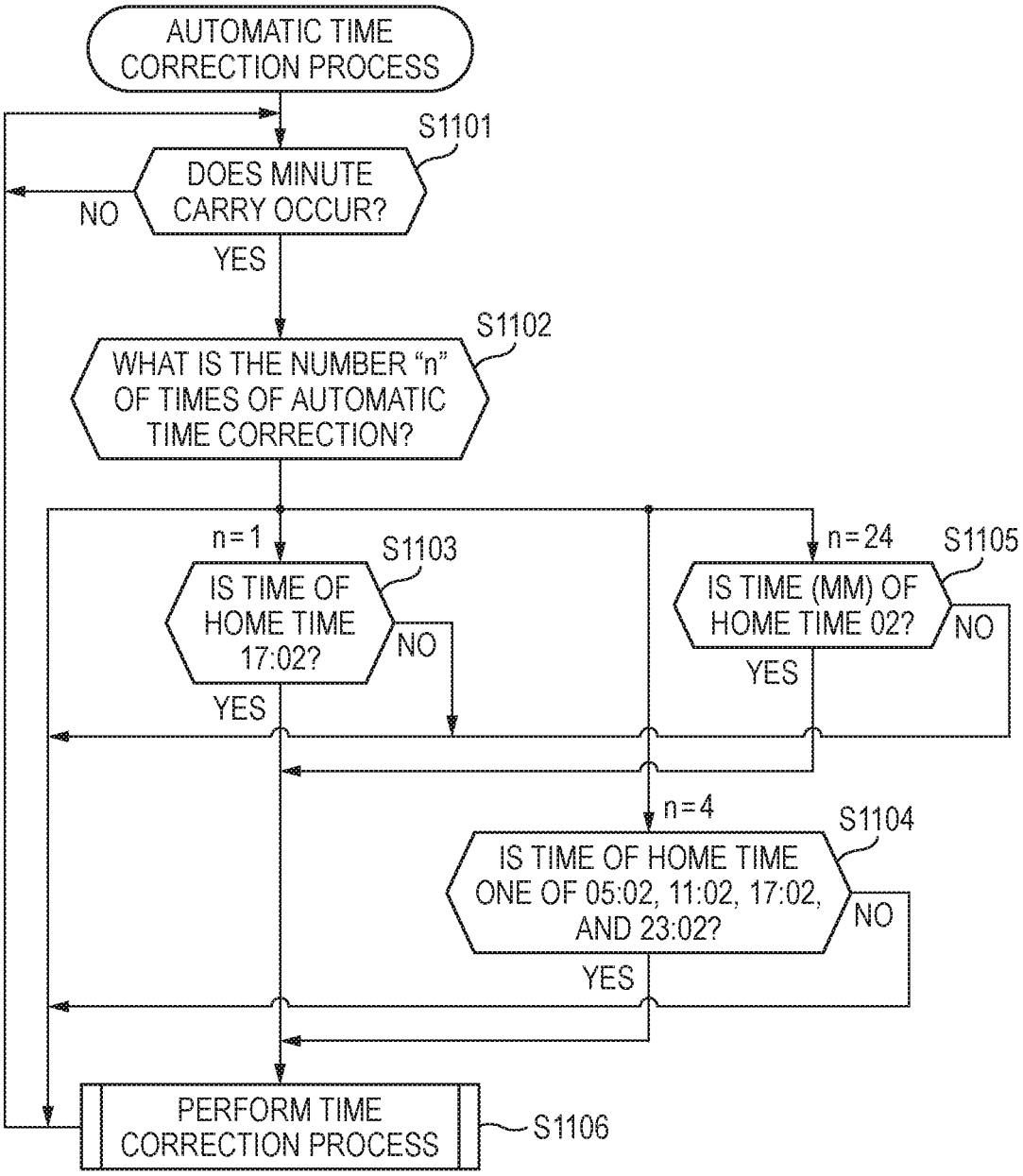
FIG. 16 is a flow chart illustrating the control procedure of an automatic time correction process which is performed by the control unit of the electronic timepiece according to the fifth embodiment.

According to the number of times of automatic time correction set by the above-described process, the control unit 210 can perform the automatic time correction process shown in FIG. 16, similarly in the fifth embodiment.

As described above, as the period of the sleep state in which the predetermined operation is not performed is long, the control unit 210 of the electronic timepiece 1 according to the present embodiment decreases the frequency at which the time correction process should be performed. Therefore, while the electronic timepiece 1 is not used, the control unit sets a low frequency at which the time correction process should be performed. Therefore, it is possible to further suppress the power consumption of the electronic timepiece 1.

Seventh Embodiment

Figure 19:
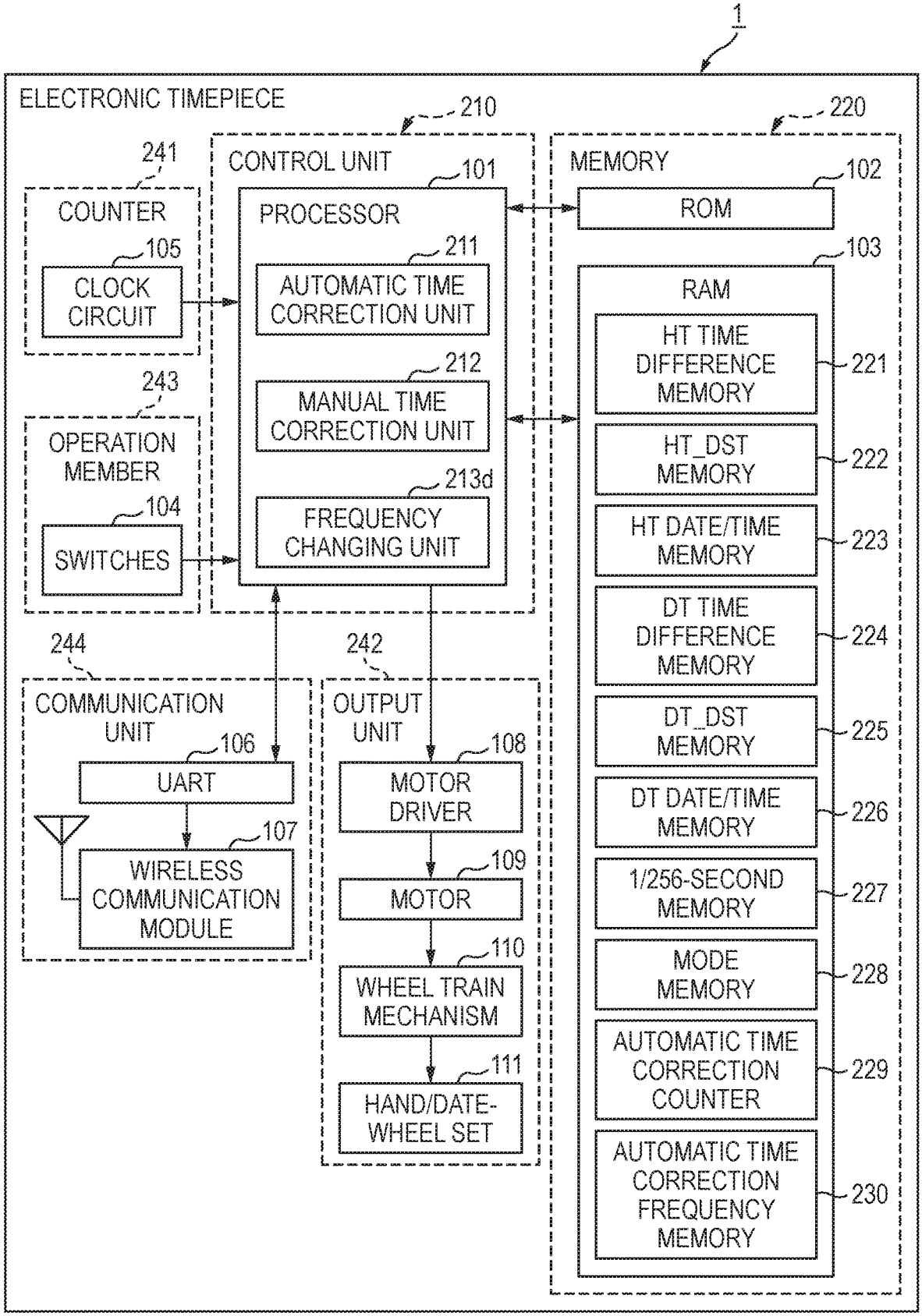
FIG. 19 is a block diagram illustrating the functional configuration of an electronic timepiece according to a seventh embodiment.

The electronic timepiece 1 according to any one of the first embodiment to the sixth embodiment may be configured to decrease the frequency at which the time correction process should be performed as the period the time correction process has failed is long and lengthens. Hereinafter, the functional configuration of an electronic timepiece 1 according to a seventh embodiment will be described. As shown in FIG. 19, in the electronic timepiece 1, the control unit 210 functions as a frequency changing unit 213*d*, instead of the frequency changing unit 213 of the first embodiment.

The control unit 210 which functions as the frequency changing unit 213*d* changes the frequency at which the time correction process should be performed, according to the period when the time correction process has failed. For example, in the time correction process, if the external device is separated from the electronic timepiece 1 or the external device is not scanned, the electronic timepiece fails in connection with the external device. In this case, the control unit 210 determines that the time connection process has failed. Also, as the period when the time correction process has failed is long and lengthens, the control unit 210 decreases the frequency at which the time correction process should be performed.

Figure 20:
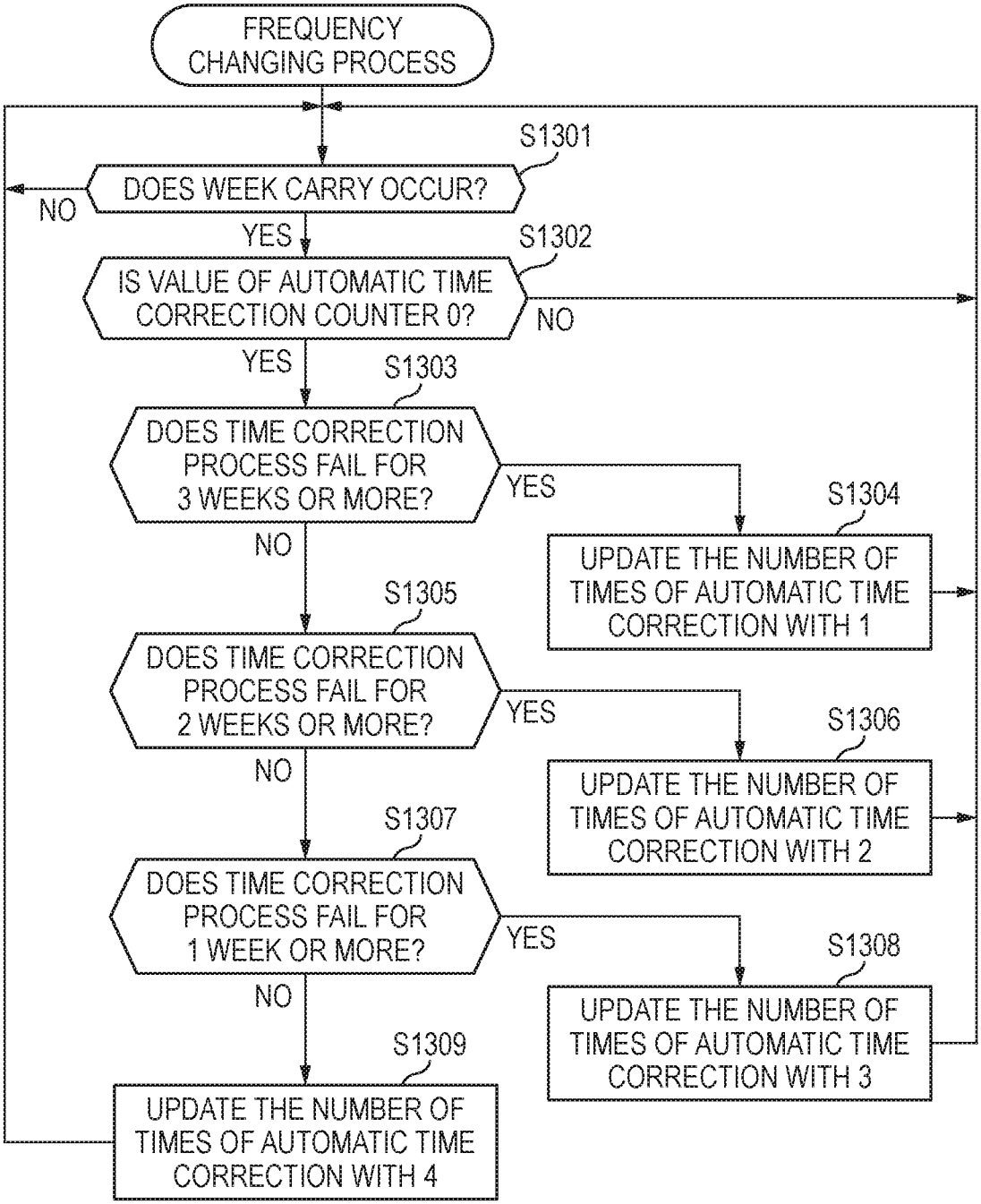
FIG. 20 is a flow chart illustrating the control procedure of a frequency changing process which is performed by a control unit of the electronic timepiece according to the seventh embodiment.

A frequency changing process of the electronic timepiece 1 according to the present embodiment will be described with reference to FIG. 20. If a week carry (start of Sunday of a new week at 1 second from 23:59:59 on Saturday of each week) occurs, the control unit 210 performs the frequency changing process.

First, in STEP S1301, the control unit 210 determines whether a week carry (start of a new week) has occurred. In the case where a week carry has not occurred ("No" in STEP S1301), the control unit 210 stands by. In the case where a week carry has occurred ("Yes" in STEP S1301), in STEP S1302, the control unit 210 determines whether the value of the automatic time correction counter 229 is 0. In the case where the value of the automatic time correction counter 229 is not 0 ("No" in STEP S1302), the control unit 210 returns to STEP S1301.

In the case where the value of the automatic time correction counter 229 is 0 ("Yes" in STEP S1302), in STEP S1303, the control unit 210 determines whether the time correction process has failed for 3 weeks or more. In the case where the time correction process has failed for 3 weeks or more ("Yes" in STEP S1303), in STEP S1304, the control unit 210 updates the number of times of automatic time correction stored in the automatic time correction frequency memory 230 with 1. Then, the control unit 210 returns to STEP S1301.

In the case where the time correction process has not failed for 3 weeks or more ("No" in STEP S1303), in STEP S1305, the control unit 210 determines whether the time correction process has failed for 2 weeks or more. In the case where the time correction process has failed for 2 weeks or more ("Yes" in STEP S1305), in STEP S1306, the control unit 210 updates the number of times of automatic time correction stored in the automatic time correction frequency memory 230 with 2. Then, the control unit 210 returns to STEP S1301.

In the case where the time correction process has not failed for 2 weeks or more ("No" in STEP S1305), in STEP S1307, the control unit 210 determines whether the time correction process has failed for 1 week or more. In the case where the time correction process has failed for 1 week or more ("Yes" in STEP S1307), in STEP S1308, the control unit 210 updates the number of times of automatic time correction stored in the automatic time correction frequency memory 230 with 3. Then, the control unit 210 returns to STEP S1301.

In the case where the time correction process has not failed for 1 week or more ("No" in STEP S1307), the control unit 210 updates the number of times of automatic time correction stored in the automatic time correction frequency memory 230 with 4 in STEP S1309, and returns to STEP S1301.

By the above-described process, the control unit 210 decreases the number of times of automatic time correction by 1 whenever the period when the time correction process has failed is long and lengthens by 1 week. Also, if the period when the time correction process has failed becomes 3 weeks or more, the control unit 210 sets the frequency at which the time correction process should be performed to once per day.

Figure 13:
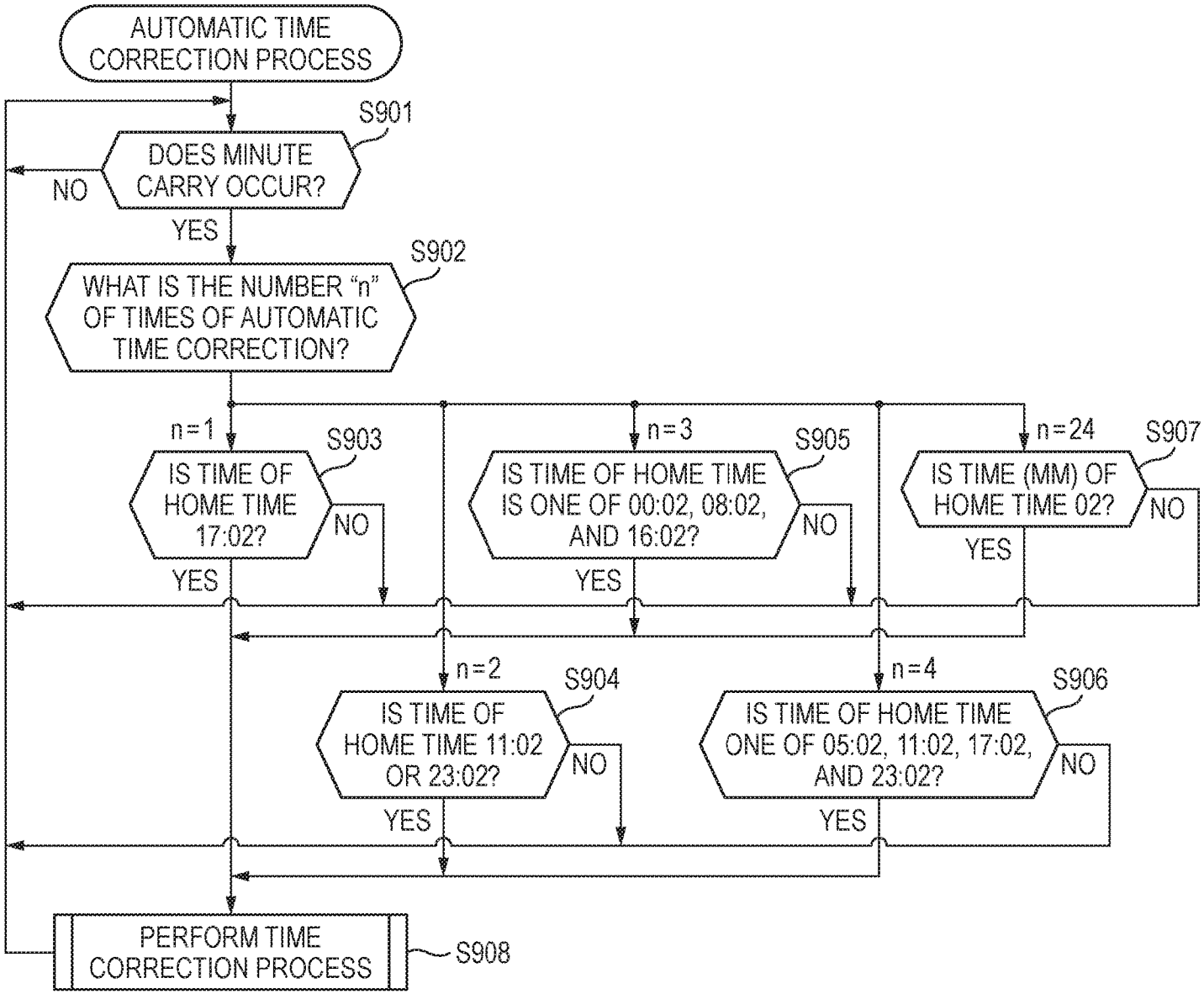
FIG. 13 is a flow chart illustrating the control procedure of an automatic time correction process which is performed by the control unit of the electronic timepiece according to the fourth embodiment.

According to the number of times of automatic time correction set by the above-described process, the control unit 210 can perform the automatic time correction process shown in FIG. 13, similarly in the fourth embodiment.

As described above, the control unit 210 of the electronic timepiece 1 according to the present embodiment decreases the frequency at which the time correction process should be performed as the period when the time correction process has failed is long and lengthens. Therefore, while the electronic timepiece 1 cannot access the external device, the control unit sets a low frequency at which the time correction process should be performed. Therefore, it is possible to further suppress the power consumption of the electronic timepiece 1.

However, the present invention is not limited to the above-described embodiments, and can be modified in various forms.

For example, in the first embodiment to the seventh embodiment described above, the example in which the electronic timepiece 1 receives the external time by wireless communication based on BLE with the external device. However, the communication method between the electronic timepiece 1 and the external device is not limited thereto. For example, the electronic timepiece 1 may receive a standard long wave or a GPS wave from a standard-long-wave transmitting station or a GPS (Global Positioning System) satellite which is an external device, and correct the time clocked by the counter 241, on the basis of the wave received from the transmitting station or the GPS satellite.

Figure 21:
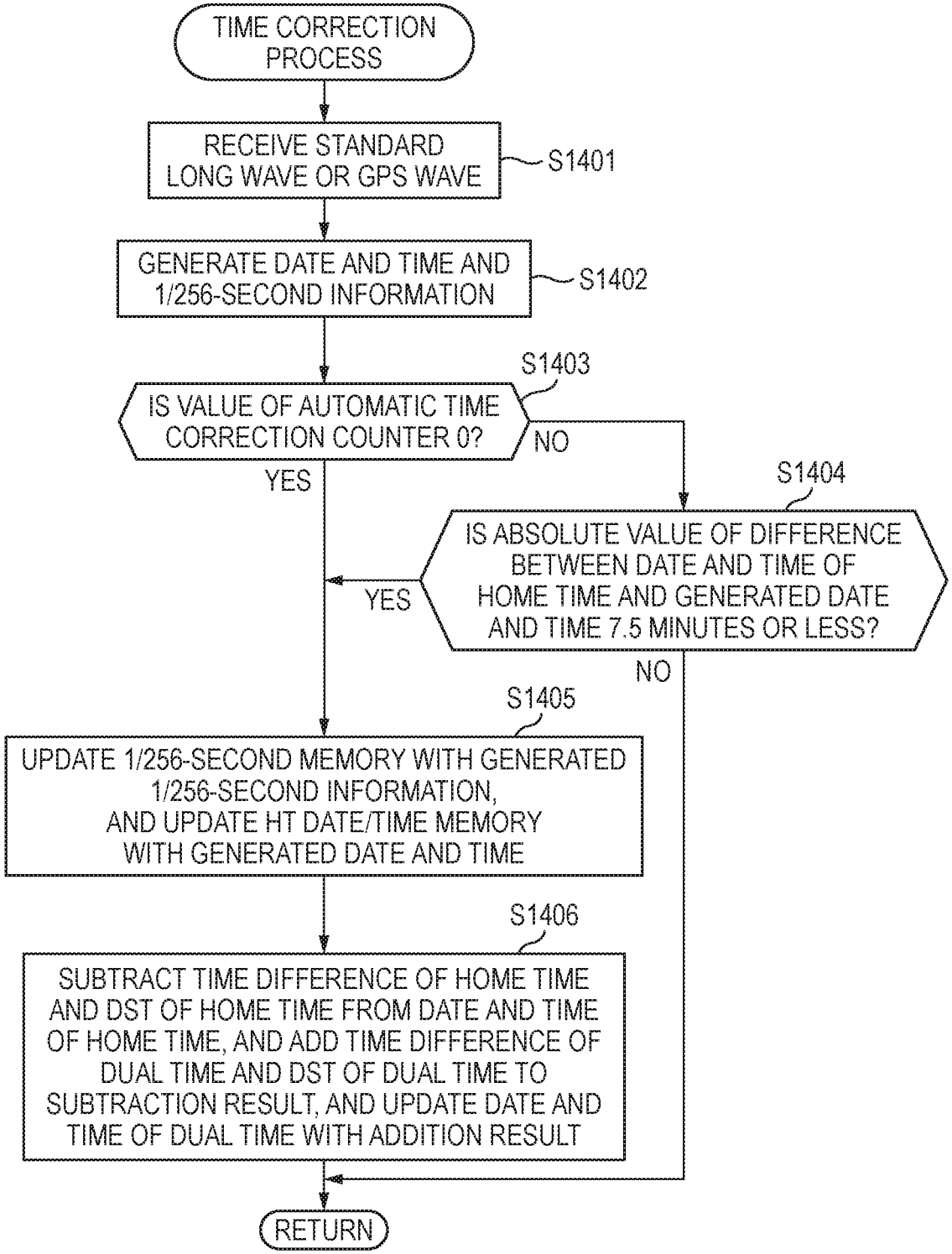
FIG. 21 is a flow chart illustrating the control procedure of a time correction process which is performed by a control unit of an electronic timepiece according to a modification.

Hereinafter, a modification in which the electronic timepiece 1 according to the first embodiment corrects the time by receiving a standard long wave or a GPS wave instead of wireless communication based on BLE with the external device will be described. FIG. 21 is a flow chart of a time correction process which the control unit 210 of the electronic timepiece 1 according to the present modification performs instead of the time correction process of the first embodiment shown in FIG. 7.

First, in STEP S1401, the control unit 210 receives a standard long wave or a GPS wave via the communication unit 244. In the case of receiving a standard long wave, a standard-long-wave transmitting station may be selected on the basis of the time difference of the home time (the city code).

Subsequently, in STEP S1402, the control unit 210 generates the date and time and 1/256-second information of the reception area on the basis of the received standard long wave or the received GPS wave.

Next, in STEP S1403, the control unit 210 determines whether the value of the automatic time correction counter 229 is 0. In the case where the value of the automatic time correction counter 229 is not 0 ("No" in STEP S1403), in STEP S1404, the control unit determines whether the absolute value of the difference between the date and time of the home time stored in the HT date/time memory 223 and the generated date and time is 7.5 minutes or less, or not. In the case where the absolute value is not 7.5 minutes or less ("No" in STEP S1404), the control unit 210 returns to STEP S401 of the automatic time correction process shown in FIG. 6.

In the case where the value of the automatic time correction counter 229 is 0 ("Yes" in STEP S1403), or in the case where the absolute value of the difference between the date and time of the home time stored in the HT date/time memory 223 and the generated date and time is 7.5 minutes or less ("Yes" in STEP S1404), in STEP S1405, the control unit 210 updates the 1/256-second memory 227 with the generated 1/256-second information, and updates the HT date/time memory 223 with the generated date and time. However, unlike the first embodiment, in the present modification, the daylight saving time information and the time difference are not corrected.

Subsequently, in STEP S1406, the control unit 210 calculates Coordinated Universal Time (UTC) by subtracting the time difference stored in the HT time difference memory 221 and the daylight saving time information stored in the HT_DST memory 222 from the date and time of the home time stored in the HT date/time memory 223, and obtains the date and time of the dual time by adding the time difference stored in the DT time difference memory 224 and the daylight saving time information stored in the DT_DST memory 225 to the Coordinated Universal Time (UTC), and stores the obtained date and time in the DT date/time memory 226. Then, the control unit 210 returns to STEP S401 of the automatic time correction process shown in FIG. 6.

By the above-described process, the electronic timepiece 1 according to the present modification can correct the time clocked by the counter 241, on the basis of the standard long wave or the GPS wave. Also, similarly in the first embodiment, if the operation member 243 receives a time correction operation, the electronic timepiece 1 according to the present modification sets a frequency at which the time correction process should be performed, higher than that before the reception of the time correction operation, until the predetermined time elapses. Therefore, after the user manually corrects the time of the electronic timepiece 1, even if the user moves to another time zone, it is possible to quickly correct the time. Also, if the predetermined time elapses after reception of a time correction operation, the control unit 210 of the electronic timepiece 1 sets the original frequency again. Therefore, it is possible to suppress power consumption from increasing due to the time correction process.

Also, although the above-described flow chart is a flow chart which is used in the case where the electronic timepiece 1 according to the first embodiment corrects the time by receiving a standard long wave or a GPS wave, instead of wireless communication based on BLE with the external device, it can also be applied to the electronic timepieces 1 according to the second embodiment to the seventh embodiment.

Also, in the above description, the ROM 102 configured with a non-volatile memory such as a flash memory has been described as an example of a computer-readable medium for storing the programs related to various processes of the present invention. However, the computer-readable medium is not limited thereto, and portable recording media such as a hard disk drive (HDD), a compact disc read only memory (CD-ROM), and a digital versatile disc (DVD) can be applied. Also, as a medium for providing data on the programs according to the present invention, carrier waves also can be applied to the present invention.

Moreover, the details such as the specific components, the control procedures, and the display examples shown in the above-described embodiments can be appropriately modified without departing from the scope of the present invention.

Although some embodiments of the present invention have been described, the scope of the present invention is not limited to the above described embodiments, and includes the scopes of inventions disclosed in claims and the scopes of their equivalents.

What is claimed is:

1. A communication device comprising:

a receiver that receives, from an external device, (i) an external time and (ii) a time difference between the external time and Coordinated Universal Time;

a counter that clocks time;

an operation member that receives a time correction operation from a user to correct the time clocked by the counter; and a processor that controls the receiver to receive the external time, and that controls to perform a time correction process to correct the time clocked by the counter to the received external time, wherein the processor performs processes comprising:

setting a frequency at which the time correction process is performed after the operation member receives the time correction operation to be higher than a frequency at which the time correction process is performed before the operation member receives the time correction operation, until a predetermined time elapses; and in the time correction process, correcting the time clocked by the counter to the received external time when the difference between the time clocked by the counter and the received external time is within a predetermined range, and wherein after the time difference received by the receiver changes, as time goes on, the processor decreases the frequency at which the time correction process is performed.

2. The communication device according to claim 1, wherein:

the operation member receives, as the time correction operation, an operation to correct the time clocked by the counter to a time designated by the user.

3. The communication device according to claim 1, wherein:

the operation member receives, as the time correction operation, an operation to correct the time clocked by the counter to the received external time.

4. The communication device according to claim 1, wherein:

the processor detects a voltage of a battery which supplies power to the communication device, and decreases the frequency at which the time correction process is performed as the detected voltage decreases.

5. The communication device according to claim 1, wherein:

the communication device does not perform a predetermined operation in a sleep state, and as a period of the sleep state increases, the processor decreases the frequency at which the time correction process is performed.

6. The communication device according to claim 1, wherein:

as a period in which the time correction process has failed increases, the processor decreases the frequency at which the time correction process is performed.

7. An electronic timepiece comprising:

the communication device according to claim 1; and a display that displays the time clocked by the counter.

8. A communication method comprising:

controlling a receiver to receive, from an external device, (i) an external time and (ii) a time difference between the external time and Coordinated Universal Time;

performing a time correction process to correct time clocked by a counter to the received external time;

setting a frequency at which the time correction process is performed after an operation member receives an operation from a user to correct the time clocked by the counter to be higher than a frequency at which the time correction process is performed before the operation member receives the operation, until a predetermined time elapses; and in the time correction process, correcting the time clocked by the counter to the received external time when the difference between the time clocked by the counter and the received external time is within a predetermined range.

9. A non-transitory computer-readable recording medium storing a program readable by a computer including a receiver which receives, from an external device, (i) an external time and (ii) a time difference between the external time and Coordinated Universal Time, a counter which clocks time, and an operation member which receives a time correction operation of a user to correct the time clocked by the counter, the program being executable to cause the computer to perform operations comprising:

controlling the receiver to receive the external time;

performing a time correction process to correct the time clocked by the counter to the received external time;

setting a frequency at which the time correction process is performed after the operation member receives the time correction operation to be higher than a frequency at which the time correction process is performed before the operation member receives the time correction operation, until a predetermined time elapses; and in the time correction process, correcting the time clocked by the counter to the received external time when the difference between the time clocked by the counter and the received external time is within a predetermined range.

* * * * *